US011752725B2

(12) United States Patent
Osterhout et al.

(10) Patent No.: US 11,752,725 B2
(45) Date of Patent: Sep. 12, 2023

(54) BOX ERECTING MACHINE

(71) Applicant: PACKSIZE LLC, Salt Lake City, UT (US)

(72) Inventors: Ryan Osterhout, West Haven, UT (US); Brady Sjoblom, North Ogden, UT (US); George Davies, Brigham City, UT (US); Clinton Engleman, Layton, UT (US)

(73) Assignee: Packsize LLC, Salt Lake City, UT (US)

( * ) Notice: Subject to any disclaimer, the term of this patent is extended or adjusted under 35 U.S.C. 154(b) by 0 days.

(21) Appl. No.: 17/416,811

(22) PCT Filed: Jan. 7, 2020

(86) PCT No.: PCT/US2020/012519
§ 371 (c)(1),
(2) Date: Jun. 21, 2021

(87) PCT Pub. No.: WO2020/146334
PCT Pub. Date: Jul. 16, 2020

(65) Prior Publication Data

US 2022/0080691 A1 Mar. 17, 2022

Related U.S. Application Data

(60) Provisional application No. 62/789,374, filed on Jan. 7, 2019.

(51) Int. Cl.
*B31B 50/80* (2017.01)
*B31B 50/00* (2017.01)
(Continued)

(52) U.S. Cl.
CPC ..... *B31B 50/80* (2017.08); *B31B 50/002* (2017.08); *B31B 50/004* (2017.08); *B31B 50/52* (2017.08);
(Continued)

(58) Field of Classification Search
CPC .. B31B 5/00; B31B 5/78; B31B 50/80; B31B 50/004; B31B 50/002; B31B 50/52;
(Continued)

(56) References Cited

U.S. PATENT DOCUMENTS 1,809,853 A 6/1931 Knowlton
2,077,428 A 4/1937 Mabon
(Continued)

FOREIGN PATENT DOCUMENTS

CN 2164350 Y 5/1994
CN 1191833 A 9/1998
(Continued)

OTHER PUBLICATIONS

International Search Report and Written Opinion issued in PCT/US2020/012519 dated Jun. 26, 2020.
(Continued)

*Primary Examiner* — Andrew M Tecco
*Assistant Examiner* — Jacob A Smith
(74) *Attorney, Agent, or Firm* — WORKMAN NYDEGGER

(57) ABSTRACT

A box erecting machine includes a transport mechanism that can move an un-erected box from an entry portion of the box erecting machine to a forward portion of the box erecting machine. The transport mechanism can include pivot arm(s) and clamp(s) for securing and moving the un-erected box. The machine can also include a box erecting assembly that erects the un-erected box. The box erecting assembly can include an opening or unfolding mechanism that opens or
(Continued)

unfolds the un-erected box into a generally rectangular tube. The machine can also include a folding mechanism and a closure mechanism for folding and securing the bottom flaps of the box.

28 Claims, 22 Drawing Sheets

(51) Int. Cl.

| | |
|---|---|
| ***B31B 50/52*** | (2017.01) |
| *B31B 50/06* | (2017.01) |
| *B31B 120/30* | (2017.01) |
| *B31B 50/62* | (2017.01) |
| *B31B 50/68* | (2017.01) |
| *B31B 110/30* | (2017.01) |

(52) U.S. Cl.
CPC ..... *B31B 50/066* (2017.08); *B31B 50/624* (2017.08); *B31B 50/68* (2017.08); *B31B 2110/30* (2017.08); *B31B 2120/302* (2017.08)

(58) Field of Classification Search
CPC . B31B 2120/302; B31B 50/624; B31B 50/68; B31B 2110/30; B65B 43/26; B65B 43/34
USPC ..... 493/128, 309, 181
See application file for complete search history.

(56) References Cited

U.S. PATENT DOCUMENTS 2,083,351 A 6/1937 Sidebotham
2,181,117 A 11/1939 Brenn
2,217,784 A 10/1940 Bennett et al.
2,256,082 A 9/1941 Feurt
2,353,419 A 7/1944 Smithson
2,449,663 A 9/1948 Marcalus
2,609,736 A 9/1952 Montgomery
2,631,509 A 3/1953 Whytlaw
2,679,195 A 5/1954 Whytlaw
2,699,711 A 1/1955 Mobley
2,798,582 A 7/1957 Monroe et al.
2,887,021 A 5/1959 Duffy et al.
2,904,789 A 9/1959 Arthur et al.
2,989,903 A 6/1961 Wilcox
3,057,267 A * 10/1962 Johnson, Jr. ..... B65B 43/345 493/309
3,096,692 A 7/1963 Crathern et al.
3,105,419 A 10/1963 La Bombard
3,108,515 A 10/1963 Stohlquist
3,119,547 A 1/1964 Nute
3,153,991 A 10/1964 Goodrich
3,242,827 A 3/1966 Winters
3,285,145 A 11/1966 Lieberman
3,288,349 A 11/1966 Palmer et al.
3,299,611 A 1/1967 Hendrick et al.
3,303,759 A 2/1967 Burke
3,308,723 A 3/1967 Bergh, Jr.
3,326,096 A 6/1967 Mendoza
3,406,611 A 10/1968 Benjamin et al.
3,418,893 A 12/1968 Stohlquist et al.
3,451,318 A 6/1969 Arnaudon et al.
3,469,508 A 9/1969 Klapp
3,476,023 A 11/1969 Fuller et al.
3,511,496 A 5/1970 Zoglmann
3,566,755 A 3/1971 Smith et al.
3,584,434 A 6/1971 Ellis
3,611,884 A 10/1971 Hottendorf
3,618,479 A 11/1971 Shields
3,628,408 A 12/1971 Rod
3,646,418 A 2/1972 Sterns et al.
3,728,945 A 4/1973 Vuilleumier
3,743,154 A 7/1973 Brewitz
3,748,972 A 7/1973 Barton
3,763,750 A * 10/1973 Reichert ..... 493/313
3,776,109 A 12/1973 Clark et al.
3,803,798 A 4/1974 Clancy
3,804,514 A 4/1974 Jasinski
3,807,726 A 4/1974 Hope et al.
3,882,764 A 5/1975 Johnson
3,891,203 A 6/1975 Schiff
3,912,389 A 10/1975 Miyamoto
3,913,464 A 10/1975 Flaum
3,949,654 A 4/1976 Stehlin
4,033,217 A 7/1977 Flaum et al.
4,044,658 A 8/1977 Mitchard
4,052,048 A 10/1977 Shirasaka
4,056,025 A 11/1977 Rubel
4,094,451 A 6/1978 Wescoat
4,121,506 A 10/1978 Van Grouw
4,123,966 A 11/1978 Buschor
4,163,414 A 8/1979 Bachman et al.
4,164,171 A 8/1979 Gorshe et al.
4,173,106 A 11/1979 Garcia et al.
4,184,770 A 1/1980 Pinior
4,191,467 A 3/1980 Schieck
4,221,373 A 9/1980 Mueller Hans
4,224,847 A 9/1980 Tokuno
4,261,239 A 4/1981 Toboshi et al.
4,264,200 A 4/1981 Tickner et al.
4,275,543 A 6/1981 Marchetti
4,295,841 A 10/1981 Ward, Jr.
4,320,960 A 3/1982 Ward et al.
4,351,461 A 9/1982 Carlsson
4,368,052 A 1/1983 Bitsky et al.
4,373,412 A 2/1983 Gerber et al.
4,375,970 A 3/1983 Murphy et al.
4,401,250 A 8/1983 Carlsson
4,414,789 A 11/1983 Domenico
4,437,570 A 3/1984 Sorenson
4,449,349 A 5/1984 Roth
4,487,596 A 12/1984 Livens et al.
4,563,169 A 1/1986 Virta et al.
4,578,054 A 3/1986 Herrin
D286,044 S 10/1986 Kando
4,623,072 A 11/1986 Lorenz
4,638,696 A 1/1987 Urwyler
4,662,150 A 5/1987 Johnson et al.
4,695,006 A 9/1987 Pool
4,714,946 A 12/1987 Bajgert et al.
4,743,131 A 5/1988 Atwell
4,749,295 A 6/1988 Bankier et al.
4,773,781 A 9/1988 Bankier
4,838,468 A 6/1989 Lesse
4,844,316 A 7/1989 Keeny
4,847,632 A 7/1989 Norris
4,854,929 A 8/1989 Szuba
4,878,521 A 11/1989 Fredrickson
4,887,412 A 12/1989 Takamura
4,923,188 A 5/1990 Neir
4,932,930 A 6/1990 Coalier et al.
4,979,932 A 12/1990 Burnside
5,005,816 A 4/1991 Stemmler et al.
5,030,192 A 7/1991 Sager
5,039,242 A 8/1991 Johnson
5,046,716 A 9/1991 Lippold
5,058,872 A 10/1991 Gladow
5,072,641 A 12/1991 Urban et al.
5,074,836 A 12/1991 Fechner et al.
5,081,487 A 1/1992 Hoyer et al.
5,090,281 A 2/1992 Paulson et al.
5,094,660 A 3/1992 Okuzawa
5,105,600 A 4/1992 Depoint et al.
5,106,359 A 4/1992 Lott
5,111,252 A 5/1992 Hamada et al.
5,118,093 A 6/1992 Makiura et al.
5,120,279 A 6/1992 Rabe
5,120,292 A 6/1992 Ueda et al.
5,120,297 A 6/1992 Adami
5,123,890 A 6/1992 Green, Jr.
5,123,894 A 6/1992 Bergeman et al.
5,137,172 A 8/1992 Wagner et al.
5,137,174 A 8/1992 Bell

(56) References Cited

U.S. PATENT DOCUMENTS 5,197,366 A 3/1993 Paulson et al.
5,240,243 A 8/1993 Gompertz et al.
5,241,353 A 8/1993 Maeshima et al.
5,263,785 A 11/1993 Negoro et al.
D344,751 S 3/1994 Keong
5,305,993 A 4/1994 Staeb
5,321,464 A 6/1994 Jessen et al.
5,335,777 A 8/1994 Murphy et al.
5,352,178 A 10/1994 Pazdernik
5,358,345 A 10/1994 Damitio
5,369,939 A 12/1994 Moen et al.
5,375,390 A 12/1994 Frigo et al.
5,393,291 A 2/1995 Wingerter
5,411,252 A 5/1995 Lowell
5,584,633 A 12/1996 Scharer
5,586,758 A 12/1996 Kimura et al.
5,624,369 A 4/1997 Bidlack et al.
5,671,593 A 9/1997 Ginestra et al.
5,716,313 A 2/1998 Sigrist et al.
5,727,725 A 3/1998 Paskvich
5,767,975 A 6/1998 Ahlen
5,836,498 A 11/1998 Turek
5,902,223 A 5/1999 Simmons
5,927,702 A 7/1999 Ishii et al.
5,941,451 A 8/1999 Dexter
5,964,686 A 10/1999 Bidlack et al.
6,000,525 A 12/1999 Frulio
6,071,223 A 6/2000 Reider et al.
6,164,045 A 12/2000 Focke et al.
6,189,933 B1 2/2001 Felderman
6,321,650 B1 11/2001 Ogawa et al.
6,397,557 B1 6/2002 Bassissi et al.
6,428,000 B1 8/2002 Hara et al.
6,471,154 B2 10/2002 Toth
6,553,207 B2 4/2003 Tsusaka et al.
6,568,865 B1 5/2003 Fujioka et al.
6,673,001 B2 1/2004 Toth
6,690,476 B1 2/2004 Hren
6,830,328 B2 12/2004 Cuyler, Jr.
6,837,135 B2 1/2005 Michalski
6,840,898 B2 1/2005 Pettersson
6,910,997 B1 6/2005 Yampolsky et al.
6,913,568 B2 7/2005 Frank et al.
6,968,859 B1 11/2005 Nagano et al.
7,100,811 B2 9/2006 Pettersson et al.
7,115,086 B1 10/2006 Campbell, Jr.
7,121,543 B2 10/2006 Fujioka
7,201,089 B2 4/2007 Richter
7,237,969 B2 7/2007 Bartman
7,390,291 B2 6/2008 Chiu Chen
7,537,557 B2 5/2009 Holler
7,637,857 B2 12/2009 Coullery et al.
7,641,190 B2 1/2010 Hara et al.
7,647,752 B2 1/2010 Magnell
7,648,451 B2 1/2010 Calugi
7,648,596 B2 1/2010 Sharpe et al.
7,690,099 B2 4/2010 Bapst et al.
7,997,578 B2 8/2011 Saito et al.
8,277,367 B2 * 10/2012 Jannin ..... B65H 3/0808 493/309
D703,246 S 4/2014 Pettersson et al.
8,999,108 B2 4/2015 Nagao et al.
9,069,151 B2 6/2015 Conner
9,120,284 B2 9/2015 Capoia
9,199,794 B2 12/2015 Nadachi et al.
9,227,373 B2 1/2016 Pettersson et al.
9,329,565 B2 5/2016 Osaki
9,352,526 B2 5/2016 Pettersson
9,924,502 B2 3/2018 Choi et al.
9,969,142 B2 5/2018 Pettersson et al.
10,093,438 B2 10/2018 Pettersson
10,286,621 B2 5/2019 Toro
2002/0017754 A1 2/2002 Kang
2002/0066683 A1 6/2002 Sanders
2002/0091050 A1 7/2002 Bacciottini et al.
2002/0115548 A1 8/2002 Lin et al.
2002/0125712 A1 9/2002 Felderman
2002/0139890 A1 10/2002 Toth
2003/0102244 A1 6/2003 Sanders
2003/0217628 A1 11/2003 Michalski
2004/0060264 A1 4/2004 Miller
2004/0082453 A1 4/2004 Pettersson
2004/0092374 A1 5/2004 Cheng
2004/0144555 A1 7/2004 Buekers et al.
2004/0198577 A1 10/2004 Blumle
2004/0261365 A1 12/2004 White
2005/0079965 A1 4/2005 Moshier et al.
2005/0103923 A1 5/2005 Pettersson et al.
2005/0215409 A1 9/2005 Abramson et al.
2005/0280202 A1 12/2005 Vila et al.
2006/0100079 A1 5/2006 Graham et al.
2006/0178248 A1 8/2006 Coullery et al.
2006/0180438 A1 8/2006 Mosli et al.
2006/0180991 A1 8/2006 Nakahata et al.
2006/0181008 A1 8/2006 Van et al.
2007/0079575 A1 4/2007 Monti
2007/0228119 A1 10/2007 Barner
2007/0287623 A1 12/2007 Carlson et al.
2007/0289253 A1 12/2007 Miller
2008/0020916 A1 1/2008 Magnell
2008/0037273 A1 2/2008 Muehlemann et al.
2008/0066632 A1 3/2008 Raueiser
2008/0115641 A1 5/2008 Freyburger et al.
2008/0148917 A1 6/2008 Pettersson
2008/0300120 A1 12/2008 Sato
2009/0062098 A1 3/2009 Inoue et al.
2009/0178528 A1 7/2009 Adami
2009/0199527 A1 8/2009 Wehr et al.
2010/0041534 A1 2/2010 Harding et al.
2010/0111584 A1 5/2010 Shiohara et al.
2010/0206582 A1 8/2010 Meyyappan et al.
2010/0210439 A1 8/2010 Goto
2010/0263333 A1 10/2010 Langen
2011/0026999 A1 2/2011 Kohira
2011/0092351 A1 4/2011 Hatano et al.
2011/0099782 A1 5/2011 Schonberger et al.
2011/0110749 A1 5/2011 Carter et al.
2011/0171002 A1 7/2011 Pettersson
2011/0229191 A1 9/2011 Nomi
2011/0230325 A1 9/2011 Harding et al.
2011/0319242 A1 12/2011 Pettersson
2012/0021884 A1 1/2012 Musha
2012/0028776 A1 2/2012 Pettersson et al.
2012/0100976 A1 4/2012 Graham et al.
2012/0106963 A1 5/2012 Huang et al.
2012/0122640 A1 5/2012 Pazdernik et al.
2012/0122646 A1 * 5/2012 Murano ..... B65B 43/305 493/309
2012/0129670 A1 5/2012 Pettersson et al.
2012/0131888 A1 5/2012 Pettersson et al.
2012/0139670 A1 6/2012 Yamagata et al.
2012/0142512 A1 6/2012 Keller
2012/0242512 A1 9/2012 Horstemeyer
2012/0319920 A1 12/2012 Athley et al.
2012/0328253 A1 12/2012 Hurley et al.
2013/0000252 A1 1/2013 Pettersson et al.
2013/0045847 A1 2/2013 Capoia
2013/0104718 A1 5/2013 Tai
2013/0108227 A1 5/2013 Conner
2013/0130877 A1 5/2013 Su
2013/0146355 A1 6/2013 Strasser et al.
2013/0210597 A1 8/2013 Pettersson
2013/0294735 A1 11/2013 Burris et al.
2013/0333538 A1 12/2013 Long et al.
2014/0078635 A1 3/2014 Conner et al.
2014/0091511 A1 4/2014 Martin
2014/0101929 A1 4/2014 Kim et al.
2014/0140671 A1 5/2014 Islam
2014/0315701 A1 10/2014 Pettersson
2014/0336026 A1 11/2014 Pettersson
2014/0357463 A1 12/2014 Kojima
2015/0018189 A1 1/2015 Pettersson et al.
2015/0019387 A1 1/2015 Pettersson et al.
2015/0053349 A1 2/2015 Mori et al.

(56) References Cited

U.S. PATENT DOCUMENTS

| | | | |
|---|---|---|---|
| 2015/0055926 | A1 | 2/2015 | Strasser et al. |
| 2015/0103923 | A1 | 4/2015 | Ramasubramonian et al. |
| 2015/0143777 | A1 | 5/2015 | Rapp et al. |
| 2015/0148210 | A1 | 5/2015 | Sibthorpe |
| 2015/0155697 | A1 | 6/2015 | Loveless et al. |
| 2015/0224731 | A1 | 8/2015 | Ponti |
| 2015/0273897 | A1 | 10/2015 | Kato et al. |
| 2015/0355429 | A1 | 12/2015 | Villegas et al. |
| 2015/0360433 | A1 | 12/2015 | Feijen et al. |
| 2015/0360801 | A1 | 12/2015 | Sytema |
| 2016/0001441 | A1 | 1/2016 | Osterhout et al. |
| 2016/0049782 | A1 | 2/2016 | Strasser et al. |
| 2016/0122044 | A1 | 5/2016 | Evers et al. |
| 2016/0184142 | A1 | 6/2016 | Vanvalkenburgh et al. |
| 2016/0185475 | A1 | 6/2016 | Pettersson |
| 2016/0241468 | A1 | 8/2016 | Sabella et al. |
| 2016/0340067 | A1 | 11/2016 | Winkler et al. |
| 2017/0080666 | A1 | 3/2017 | Graham et al. |
| 2017/0355166 | A1 | 12/2017 | Jonker |
| 2017/0361560 | A1 | 12/2017 | Osterhout |
| 2018/0178476 | A1 | 6/2018 | Pettersson et al. |
| 2018/0201465 | A1 | 7/2018 | Osterhout |
| 2018/0265228 | A1 | 9/2018 | Hagestedt et al. |
| 2019/0002137 | A1 | 1/2019 | Pettersson |
| 2019/0184670 | A1 | 6/2019 | Davies et al. |
| 2019/0308383 | A1 | 10/2019 | Provoost et al. |
| 2019/0308761 | A1 | 10/2019 | Provoost et al. |
| 2019/0329513 | A1 | 10/2019 | Pettersson et al. |
| 2019/0389611 | A1 | 12/2019 | Pettersson |
| 2021/0001583 | A1 | 1/2021 | Osterhout |
| 2021/0283878 | A1 | 9/2021 | Pettersson et al. |
| 2022/0032570 | A1 | 2/2022 | Davies et al. |
| 2022/0144469 | A1 | 5/2022 | Pettersson |

FOREIGN PATENT DOCUMENTS

| | | | | |
|---|---|---|---|---|
| CN | 1366487 | A | 8/2002 | |
| CN | 1876361 | A | 12/2006 | |
| CN | 102371705 | A | 3/2012 | |
| CN | 202412794 | U | 9/2012 | |
| CN | 102753442 | A | 10/2012 | |
| CN | 102941592 | A | 2/2013 | |
| CN | 104169073 | A | 11/2014 | |
| CN | 104185538 | A | 12/2014 | |
| CN | 104718067 | A | 6/2015 | |
| CN | 104812560 | A | 7/2015 | |
| CN | 204773785 | U | 11/2015 | |
| CN | 106079570 | A | 11/2016 | |
| DE | 1082227 | B | 5/1960 | |
| DE | 1212854 | B | 3/1966 | |
| DE | 2700004 | A1 | 7/1978 | |
| DE | 3343523 | A1 | 6/1985 | |
| DE | 3825506 | A1 | 2/1990 | |
| DE | 19541061 | C1 | 11/1996 | |
| DE | 10355544 | A1 | 6/2005 | |
| DE | 102005063193 | A1 | 7/2007 | |
| DE | 102008035278 | A1 | 2/2010 | |
| EA | 013852 | B1 | 8/2010 | |
| EP | 0030366 | A1 | 6/1981 | |
| EP | 0202998 | A1 | 11/1986 | |
| EP | 0234228 | A2 * | 1/1987 | ..... B65B 43/185 |
| EP | 0234228 | A2 | 9/1987 | |
| EP | 0359005 | A1 | 3/1990 | |
| EP | 0650827 | A2 | 5/1995 | |
| EP | 0889779 | A2 | 1/1999 | |
| EP | 0903219 | A2 | 3/1999 | |
| EP | 1065162 | A2 | 1/2001 | |
| EP | 1223107 | A1 | 7/2002 | |
| EP | 1373112 | A1 | 1/2004 | |
| EP | 1428759 | A2 | 6/2004 | |
| EP | 1997736 | A2 | 12/2008 | |
| EP | 1497049 | B1 | 3/2010 | |
| EP | 2228206 | A1 | 9/2010 | |
| EP | 2377764 | A1 | 10/2011 | |
| EP | 3231594 | A1 | 10/2017 | |
| FR | 0428967 | A | 9/1911 | |
| FR | 1020458 | A | 2/1953 | |
| FR | 1592372 | A | 5/1970 | |
| FR | 2721301 | A1 | 12/1995 | |
| FR | 2770445 | A1 | 5/1999 | |
| FR | 2770455 | A1 | 5/1999 | |
| FR | 2808722 | A1 | 11/2001 | |
| FR | 2814393 | A1 | 3/2002 | |
| FR | 2976561 | A1 | 12/2012 | |
| GB | 0166622 | | 7/1921 | |
| GB | 0983946 | A | 2/1965 | |
| GB | 1362060 | A | 7/1974 | |
| GB | 1546789 | A | 5/1979 | |
| JP | 49-099239 | A | 9/1974 | |
| JP | 50-078616 | A | 6/1975 | |
| JP | 51-027619 | A | 3/1976 | |
| JP | 55-057984 | A | 4/1980 | |
| JP | 56-089937 | A | 7/1981 | |
| JP | 59-031140 | A | 2/1984 | |
| JP | 59-176836 | A | 10/1984 | |
| JP | 61-118720 | A | 6/1986 | |
| JP | 61-242837 | A | 10/1986 | |
| JP | 01-133164 | A | 5/1989 | |
| JP | 02-182443 | A | 7/1990 | |
| JP | 03-070927 | A | 3/1991 | |
| JP | 06-099526 | A | 4/1994 | |
| JP | 06-320648 | A | 11/1994 | |
| JP | 07-156305 | A | 6/1995 | |
| JP | 08-238690 | A | 9/1996 | |
| JP | 08-333036 | A | 12/1996 | |
| JP | 2000-323324 | A | 11/2000 | |
| JP | 2003-079446 | A | 3/2003 | |
| JP | 2003-165167 | A | 6/2003 | |
| JP | 2005-067019 | A | 3/2005 | |
| JP | 2005-219798 | A | 8/2005 | |
| JP | 2006-289914 | A | 10/2006 | |
| JP | 2007-185799 | A | 7/2007 | |
| JP | 2008-254789 | A | 10/2008 | |
| JP | 2009-023074 | A | 2/2009 | |
| JP | 2009-132049 | A | 6/2009 | |
| JP | 2011-520674 | A | 7/2011 | |
| JP | 2011-230385 | A | 11/2011 | |
| JP | 2015-160428 | A | 9/2015 | |
| RU | 2015030 | C1 | 6/1994 | |
| RU | 2037425 | C1 | 6/1995 | |
| RU | 2089398 | C1 | 9/1997 | |
| RU | 2136503 | C1 | 9/1999 | |
| RU | 2180646 | C1 | 3/2002 | |
| RU | 2004136918 | A | 5/2006 | |
| RU | 2287432 | C2 | 11/2006 | |
| RU | 2398674 | C1 | 9/2010 | |
| RU | 2531785 | C2 | 10/2014 | |
| RU | 2600917 | C2 | 10/2016 | |
| SE | 0450829 | B | 8/1987 | |
| SE | 450829 | B | 8/1987 | |
| SE | 541921 | C2 | 1/2020 | |
| SE | 1851054 | A1 | 3/2020 | |
| SE | 2050379 | A1 | 3/2020 | |
| SE | 543046 | C2 | 9/2020 | |
| SU | 1054863 | A1 | 11/1983 | |
| SU | 1121156 | A1 | 10/1984 | |
| SU | 1718783 | A1 | 3/1992 | |
| SU | 1756211 | A1 | 8/1992 | |
| WO | 96/14773 | A1 | 5/1996 | |
| WO | 97/31773 | A2 | 9/1997 | |
| WO | 99/17923 | A1 | 4/1999 | |
| WO | 02/79062 | A1 | 10/2002 | |
| WO | 03/89163 | A2 | 10/2003 | |
| WO | 2009/093936 | A1 | 7/2009 | |
| WO | 2010/091043 | A1 | 8/2010 | |
| WO | 2011/007237 | A1 | 1/2011 | |
| WO | 2011/100078 | A2 | 8/2011 | |
| WO | 2011/135433 | A1 | 11/2011 | |
| WO | 2012/003167 | A1 | 1/2012 | |
| WO | 2013/071073 | A1 | 5/2013 | |
| WO | 2013/071080 | A1 | 5/2013 | |
| WO | 2013/106180 | A1 | 7/2013 | |
| WO | 2013/114057 | A2 | 8/2013 | |
| WO | 2014/048934 | A1 | 4/2014 | |

(56) References Cited

FOREIGN PATENT DOCUMENTS

| | | | |
|---|---|---|---|
| WO | 2014/117816 | A1 | 8/2014 |
| WO | 2014/117817 | A1 | 8/2014 |
| WO | 2015/173744 | A1 | 11/2015 |
| WO | 2016/176271 | A1 | 11/2016 |
| WO | 2017/203401 | A1 | 11/2017 |
| WO | 2017/218296 | A1 | 12/2017 |
| WO | 2017/218297 | A1 | 12/2017 |

OTHER PUBLICATIONS

CN Office Action dated Jan. 15, 2021 for CN Application No. 201880016638.
Final Office Action received for U.S. Appl. No. 13/147,787, dated Apr. 17, 2015.
Final Office Action received for U.S. Appl. No. 13/147,787, dated Feb. 16, 2016.
Final Office Action received for U.S. Appl. No. 13/147,787, dated Mar. 7, 2017.
Final Office Action received for U.S. Appl. No. 14/357,183, dated Nov. 12, 2015.
Final Office Action received for U.S. Appl. No. 14/357,190, dated Aug. 1, 2017.
Final Office Action received for U.S. Appl. No. 14/370,729, dated Jul. 12, 2017.
Final Office Action received for U.S. Appl. No. 15/872,770, dated Sep. 16, 2020, 17 pages.
Final Office Action received for U.S. Appl. No. 16/224,708, dated May 5, 2021, 24 pages.
Final Rejection dated May 5, 2021 for U.S. Appl. No. 16/224,708.
International Search Report and Wirtten Opinion for application No. PCT/US2012/070719 dated Feb. 25, 2013.
International Search Report and Written Opinion for application No. PCT/US2017/036603 dated Oct. 18, 2017.
International Search Report and Written Opinion for application No. PCT/US2017/036606 dated Oct. 24, 2017.
International Search Report and Written Opinion for PCT/US18/14275 dated Apr. 4, 2018.
International Search Report and Written Opinion for PCT/US19/62696 dated Feb. 4, 2020.
International Search Report and Written Opinion for PCT/US2015/67375 dated Mar. 11, 2016.
International Search Report and Written Opinion for PCT/US2019/049102 dated Dec. 2, 2019.
International Search Report and Written Opinion from International Application No. PCT/US2010/022983 dated Apr. 13, 2010.
International Search Report and Written Opinion issued in PCT/US2019/038142 dated Aug. 19, 2019.
International Search Report and Written Opinion PCT/IB2019/052793 dated Nov. 11, 2019.
International Search Report and Written Opinion PCT/IB2019/052794 dated Jun. 19, 2019.
International Search Report and Written Opinion received for PCT Patent Application No. PCT/US2018/020928, dated Jun. 7, 2018, 9 pages.
International Search Report and Written Opinion received for PCT Patent Application No. PCT/US2019/049535, dated Jun. 9, 2020, 14 pages.
International Search Report and Written Opinion received for PCT Patent Application No. PCT/US2020/012519, dated Jun. 26, 2020, 20 pages.
International Search Report and Written Opinion, PCT/US2012/064403, US Search Authority, Completed Mar. 26, 2013, dated Apr. 8, 2013.
International Search Report and Written Opinion, PCT/US2012/064414, US Search Authority, Completed Jan. 4, 2013, dated Jan. 25, 2013.
International Search Report for PCT/US2011/042096 dated Oct. 28, 2011.
JP Office Action dated Jan. 7, 2022 for JP Application No. 2019548058.
List of references cited by examiner Mailed on Aug. 5, 2021 for U.S. Appl. No. 16/491,088.
List of references cited by examiner Mailed on Jan. 15, 2021 for U.S. Appl. No. 16/224,708.
List of references cited by examiner Mailed on Jun. 7, 2021 for U.S. Appl. No. 16/491,088.
List of references cited by examiner Mailed on May 5, 2021 for U.S. Appl. No. 16/224,708.
Non-Final Office Action received for U.S. Appl. No. 15/872,770, dated Nov. 10, 2020, 24 pages.
Non-Final Office Action received for U.S. Appl. No. 16/224,708, dated Jan. 15, 2021, 19 pages.
Non-Final Office Action received for U.S. Appl. No. 16/310,406, dated Aug. 19, 2020, 22 pages.
Non-Final Office Action received for U.S. Appl. No. 16/491,088, dated Aug. 5, 2021, 11 pages.
Non-Final Rejection dated Aug. 5, 2021 for U.S. Appl. No. 16/491,088.
Non-Final Rejection dated Jan. 15, 2021 for U.S. Appl. No. 16/224,708.
Notice of Allowance and Fees Due (PTOL-85) dated Aug. 27, 2021 for U.S. Appl. No. 16/224,708.
Notice of Allowance and Fees Due (PTOL-85) dated Jul. 8, 2021 for U.S. Appl. No. 16/224,708.
Notice of Allowance and Fees Due (PTOL-85) dated Sep. 9, 2021 for U.S. Appl. No. 16/224,708.
Notice of Allowance and Fees Due (PTOL-85) dated Sep. 28, 2021 for U.S. Appl. No. 16/224,708.
Notice of Allowance received for U.S. Appl. No. 13/147,787, dated Jun. 26, 2017.
Notice of Allowance received for U.S. Appl. No. 13/805,602, dated Mar. 21, 2016.
Notice of Allowance received for U.S. Appl. No. 14/357,183, dated Jan. 29, 2016.
Notice of Allowance received for U.S. Appl. No. 14/357,190, dated Dec. 5, 2017.
Notice of Allowance received for U.S. Appl. No. 14/357,190, dated Jan. 12, 2018.
Notice of Allowance received for U.S. Appl. No. 14/370,729, dated May 21, 2018.
Notice of Allowance received for U.S. Appl. No. 14/970,224, dated Aug. 13, 2018.
Notice of Allowance received for U.S. Appl. No. 29/419,922, dated Nov. 29, 2013.
Non-Final Office Action received for U.S. Appl. No. 17/264,808, dated Sep. 8, 2022, 8 pages.
Office Action received for U.S. Appl. No. 13/147,787, dated Aug. 27, 2014.
Office Action received for U.S. Appl. No. 13/147,787, dated Oct. 28, 2016.
Office Action received for U.S. Appl. No. 13/147,787, dated Sep. 30, 2015.
Office Action received for U.S. Appl. No. 13/805,602, dated Dec. 2, 2015.
Office Action received for U.S. Appl. No. 14/357,183, dated Jul. 16, 2015.
Office Action received for U.S. Appl. No. 14/357,190, dated Feb. 17, 2017.
Office Action received for U.S. Appl. No. 14/370,729, dated Dec. 19, 2017.
Office Action received for U.S. Appl. No. 14/370,729, dated Jan. 26, 2017.
Office Action received for U.S. Appl. No. 14/970,224, dated May 30, 2018.
Office Action received for U.S. Appl. No. 15/616,688, dated Mar. 19, 2020.
Office Action received for U.S. Appl. No. 15/872,770, dated Mar. 27, 2020.
Office Action received for U.S. Appl. No. 15/901,089, dated Apr. 13, 2020.
Office Action received for U.S. Appl. No. 16/109,261, dated Apr. 28, 2020.
Office Action received for U.S. Appl. No. 29/419,922, dated Aug. 6, 2013.

(56) References Cited

OTHER PUBLICATIONS

Outgoing—ISA/210—International Search Report dated Jun. 7, 2018 for WO Application No. PCT/US18/020928.
Outgoing—ISA/210—International Search Report dated Jun. 9, 2020 for WO Application No. PCT/US19/049535.
Outgoing—ISA/210—International Search Report dated Jun. 26, 2020 for WO Application No. PCT/US20/012519.
Requirement for Restriction/Election dated Jun. 11, 2020 for U.S. Appl. No. 16/224,708.
RU Office Action dated Jun. 24, 2021 for RU Application No. 2019130055.
RU Search report dated Jun. 24, 2021 for RU Application No. 2019130055.
SE Search report dated Nov. 16, 2020 for SE Application No. 2050379.
Non-Final Office Action received for U.S. Appl. No. 17/586,517, dated Jan. 20, 2023, 14 pages.

* cited by examiner

BOX ERECTING MACHINE

CROSS-REFERENCE TO RELATED APPLICATIONS

This application claims priority to PCT Application No. PCT/US2020/012519 filed Jan. 7, 2020, entitled "BOX ERECTING MACHINE", which claims priority to and the benefit of U.S. Provisional Application No. 62/789,374, filed Jan. 7, 2019, and entitled "Box Erecting Machine", the entire content of which is incorporated herein by reference.

BACKGROUND

1. The Field of the Invention

Exemplary embodiments of the disclosure relate to systems, methods, and devices for erecting box templates into boxes.

2. The Relevant Technology

Shipping and packaging industries frequently use paperboard and other sheet material processing equipment that converts sheet materials into box templates. One advantage of such equipment is that a shipper may prepare boxes of required sizes as needed in lieu of keeping a stock of standard, pre-made boxes of various sizes. Consequently, the shipper can eliminate the need to forecast its requirements for particular box sizes as well as to store pre-made boxes of standard sizes. Instead, the shipper may store one or more bales of fanfold material, which can be used to generate a variety of box sizes based on the specific box size requirements at the time of each shipment. This allows the shipper to reduce storage space normally required for periodically used shipping supplies as well as to reduce the waste and costs associated with the inherently inaccurate process of forecasting box size requirements since the items shipped and their respective dimensions vary from time to time.

In addition to reducing the inefficiencies associated with storing pre-made boxes of numerous sizes, creating custom sized boxes also reduces packaging and shipping costs. In the fulfillment industry it is estimated that shipped items are typically packaged in boxes that are about 65% larger than the shipped items. Boxes that are too large for a particular item are more expensive than a box that is custom sized for the item due to the cost of the excess material used to make the larger box. When an item is packaged in an oversized box, filling material (e.g., Styrofoam, foam peanuts, paper, air pillows, etc.) is often placed in the box to prevent the item from moving inside the box and to prevent the box from caving in when pressure is applied (e.g., when boxes are taped closed or stacked). These filling materials further increase the cost associated with packing an item in an oversized box.

Custom sized boxes also reduce the shipping costs associated with shipping items compared to shipping the items in oversized boxes. A shipping vehicle filled with boxes that are 65% larger than the packaged items is much less cost efficient to operate than a shipping vehicle filled with boxes that are custom sized to fit the packaged items. In other words, a shipping vehicle filled with custom sized packages can carry a significantly larger number of packages, which can reduce the number of shipping vehicles required to ship the same number of items. Accordingly, in addition or as an alternative to calculating shipping prices based on the weight of a package, shipping prices are often affected by the size of the shipped package. Thus, reducing the size of an item's package can reduce the price of shipping the item. Even when shipping prices are not calculated based on the size of the packages (e.g., only on the weight of the packages), using custom sized packages can reduce the shipping costs because the smaller, custom sized packages will weigh less than oversized packages due to using less packaging and filling material.

Although sheet material processing machines and related equipment can potentially alleviate the inconveniences associated with stocking standard sized shipping supplies and reduce the amount of space required for storing such shipping supplies, previously available machines and associated equipment have various drawbacks. For instance, previously available machines have had a significant footprint and have occupied a lot of floor space. The floor space occupied by these large machines and equipment could be better used for storage of goods to be shipped. In addition to the large footprint, the size of the previously available machines and related equipment makes manufacturing, transportation, installation, maintenance, repair, and replacement thereof time consuming and expensive.

In addition, previous box forming systems have required the use of multiple machines and significant manual labor. For instance, a typical box forming system includes a converting machine that cuts, scores, and/or creases sheet material to form a box template. Once the template is formed, an operator removes the template from the converting machine and a manufacturer's joint is created in the template. A manufacturer's joint is where two opposing ends of the template are attached to one another. This can be accomplished manually and/or with additional machinery. For instance, an operator can apply glue (e.g., with a glue gun) to one end of the template and can fold the template to join the opposing ends together with the glue therebetween. Alternatively, the operator can at least partially fold the template and insert the template into a gluing machine that applies glue to one end of the template and joins the two opposing ends together. In either case, significant operator involvement is required. Additionally, using a separate gluing machine complicates the system and can significantly increase the size of the overall system.

While there are some box forming machines that both create box templates (e.g., create cuts, scores, creases, etc. in sheet material) and form the manufacturer's joints, an operator still has to retrieve the resulting box templates from the machine and erect the box templates into boxes. More specifically, in typical box forming processes, once the box template has been created and the manufacturer's joint has been formed (with one or multiple machines and/or manual labor), an operator manually erects the box. Upon completion of the manufacturer's joint, the box template is in a flat configuration (e.g., the box template is folded in half to enable the formation of the manufacturer's joint). The operator partially opens or unfolds the box template so that the box template forms a rectangular tube. From there, the operator (either manually or with the assistance of another machine) folds in and secures the bottom flaps of the box template (e.g., with tape, glue, staples, etc.) to create a closed bottom of the box. Thereafter, the operator can fill the box and close and secure the top flaps.

Accordingly, it would be advantageous to have a machine that can take a previously formed box template (with the manufacturer's joint already formed) and erect a box therefrom and close at least the bottom flaps thereof with minimal or no manual labor required.

BRIEF SUMMARY

Exemplary embodiments of the disclosure relate to systems, methods, and devices for erecting box templates into boxes. For instance, one embodiment is directed to a box erecting machine that includes a transport mechanism and a box erecting assembly. The transport mechanism can pivot between a rear position and a forward position to transport an un-erected box from an entry portion of the box erecting machine to a forward portion of the box erecting machine. The transport mechanism can include one or more pivot arms that can pivot the transport mechanism between the rear position and the forward position. The transport mechanism can also include a clamp connected to the one or more pivot arms. The clamp can be configured to selectively clamp onto an un-erected box and can be movable to reposition and/or reorient the un-erected box as the transport mechanism pivots between the rear and forward positions.

The box erecting assembly can be configured to erect the un-erected box. The box erecting assembly can include first and second vacuum heads, folding bars, and a closure mechanism. The first vacuum head can have one or more vacuum cups configured to selectively secure to one or more planar surfaces of the un-erected box. The second vacuum head can have one or more vacuum cups configured to selectively secure to one or more other planar surfaces of the un-erected box. The second vacuum head can be configured to pivot between a first position and a second position to partially open or unfold the un-erected box into a generally rectangular tube. The one or more folding bars can be configured to fold closed bottom flaps of the un-erected box and the closure mechanism can be configured to secure the bottom flaps in a closed configuration.

According to another embodiment, a box erecting machine includes a transport mechanism that can pivot between a rear position and a forward position to transport an un-erected box from an entry portion of the box erecting machine to a forward portion of the box erecting machine. The transport mechanism can include one or more pivot arms that can pivot the transport mechanism between the rear position and the forward position, a track mounted on the one or more pivot arms, and a clamp movably mounted on the track. The clamp can be configured to selectively clamp onto an un-erected box. The clamp is movable along the track to reposition the un-erected box along a width of the box erecting machine as the transport mechanism pivots between the rear and forward positions. The clamp can also be rotatable about an axis to reorient the un-erected box from a generally horizontal orientation to a generally vertical orientation.

According to another embodiment, a box erecting machine includes a box erecting assembly configured to erect the un-erected box. The box erecting assembly includes a first vacuum head having one or more vacuum cups configured to selectively secure to one or more planar surfaces of the un-erected box. The box erecting assembly also includes a second vacuum head having one or more vacuum cups configured to selectively secure to one or more other planar surfaces of the un-erected box. The second vacuum head is configured to pivot between a first position and a second position to partially open or unfold the un-erected box into a generally rectangular tube. The box erecting assembly can also include one or more folding bars configured to fold closed bottom flaps of the un-erected box and a closure mechanism that is configured to secure the bottom flaps in a closed configuration.

In another exemplary embodiment, a method for erecting an un-erected box into a box is provided. The method includes providing an un-erected box having first, second, third, and fourth sidewall panels and first, second, third, and fourth bottom flaps extending from the corresponding first, second, third, and fourth sidewall panels. The un-erected box is folded between the second and third sidewall panels and the first and fourth sidewall panels are secured to one another. The method further includes folding one or more of the bottom flaps relative to the corresponding sidewall panels such that the one or more bottom flaps and the corresponding sidewall panel(s) form one or more angles of greater than 0°. Thereafter, the un-erected box is arranged so that the first, second, third, and fourth sidewall panels form a generally rectangular tube while the one or more bottom flaps are oriented at an angle of greater than 0° relative to the corresponding sidewall panel(s). The first and third bottom flaps are folded to a closed position and then the second and fourth bottom flaps are folded to a closed position.

In still yet another embodiment, a box erecting assembly is provided for erecting an un-erected box into an erected box. The un-erected box includes first, second, third, and fourth sidewall panels and first, second, third, and fourth bottom flaps extending from the corresponding first, second, third, and fourth sidewall panels. The box erecting assembly includes one or more attachment heads that can selectively secure to one or more planar surfaces of the un-erected box. The one or more attachment heads can hold the un-erected box in a first configuration and open or unfold the un-erected box into a second configuration where the first, second, third, and fourth sidewall panels form a generally rectangular tube. The box erecting assembly also includes one or more folding bars that can fold bottom flaps of the un-erected box. The one or more folding bars are configured to fold one or more of the bottom flaps into an angled orientation. The one or more folding bars and the one or more attachment heads can maintain the one or more bottom flaps in an angled orientation while the one or more attachment heads open or unfold the un-erected box into the second configuration and while the one or more folding bars fold the bottom flaps to a closed configuration. The box erecting assembly also includes a closure mechanism that can secure the bottom flaps in the closed configuration.

In another embodiment, a method for erecting an un-erected box into a box includes folding one or more bottom flaps relative to corresponding sidewall panel(s) such that the one or more bottom flaps and the corresponding sidewall panel(s) form one or more angles of greater than 0°. The method also includes arranging the un-erected box so that the first, second, third, and fourth sidewall panels form a generally rectangular tube while the one or more bottom flaps are oriented at an angle of greater than 0° relative to the corresponding sidewall panel(s). The method further includes folding the first and third bottom flaps to a closed position and folding the second and fourth bottom flaps to a closed position.

In a further embodiment, a box erecting assembly is provided for erecting an un-erected box into an erected box. The box erecting assembly includes an opening or unfolding mechanism configured to open or unfold the un-erected box from a first configuration into a second configuration where the first, second, third, and fourth sidewall panels form a generally rectangular tube. The assembly also includes a folding mechanism configured to fold bottom flaps of the un-erected box. The folding mechanism is configured to fold one or more of the bottom flaps into an angled orientation relative to the associated sidewall panel(s). The folding mechanism is also configured to maintain the one or more bottom flaps in an angled orientation while the opening or unfolding mechanism opens or unfolds the un-erected box into the second configuration. The assembly also includes a closure mechanism that is configured to secure the bottom flaps in the closed configuration.

In another embodiment, a box erecting machine includes a transport mechanism that can pivot between a rear position and a forward position to transport an un-erected box from an entry portion of the box erecting machine to a forward portion of the box erecting machine. The transport mechanism includes one or more pivot arms that can pivot the transport mechanism between the rear position and the forward position and a clamp configured to selectively clamp onto an un-erected box. The clamp is movable to reposition the un-erected box along a width of the box erecting machine as the transport mechanism pivots between the rear and forward positions. The clamp is rotatable about an axis. Rotation of the clamp about the axis is configured to reorient the un-erected box from a generally horizontal orientation to a generally vertical orientation.

In still another embodiment, a method for erecting a box includes providing an un-erected box having a plurality of sidewall panels and a plurality of flaps extending from the plurality of sidewall panels. At least one sidewall panel of the plurality of sidewall panels has a crease or fold extending therethrough. The method includes folding at least one flap associated with the at least sidewall panel relative to the at least one sidewall panel. Folding the at least one flap relative to the at least one sidewall panel flattens or unfolds the crease or fold extending through the at least one sidewall panel. The method also includes, while the at least one flap is folded relative to the at least one sidewall panel, arranging the un-erected box so that the plurality of sidewall panels form a generally rectangular tube.

These and other objects and features of the present disclosure will become more fully apparent from the following description and appended claims, or may be learned by the practice of the disclosure as set forth hereinafter.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only illustrated embodiments of the invention and are therefore not to be considered limiting of its scope. The invention will be described and explained with additional specificity and detail through the use of the accompanying drawings in which.

DETAILED DESCRIPTION

Figure 1:
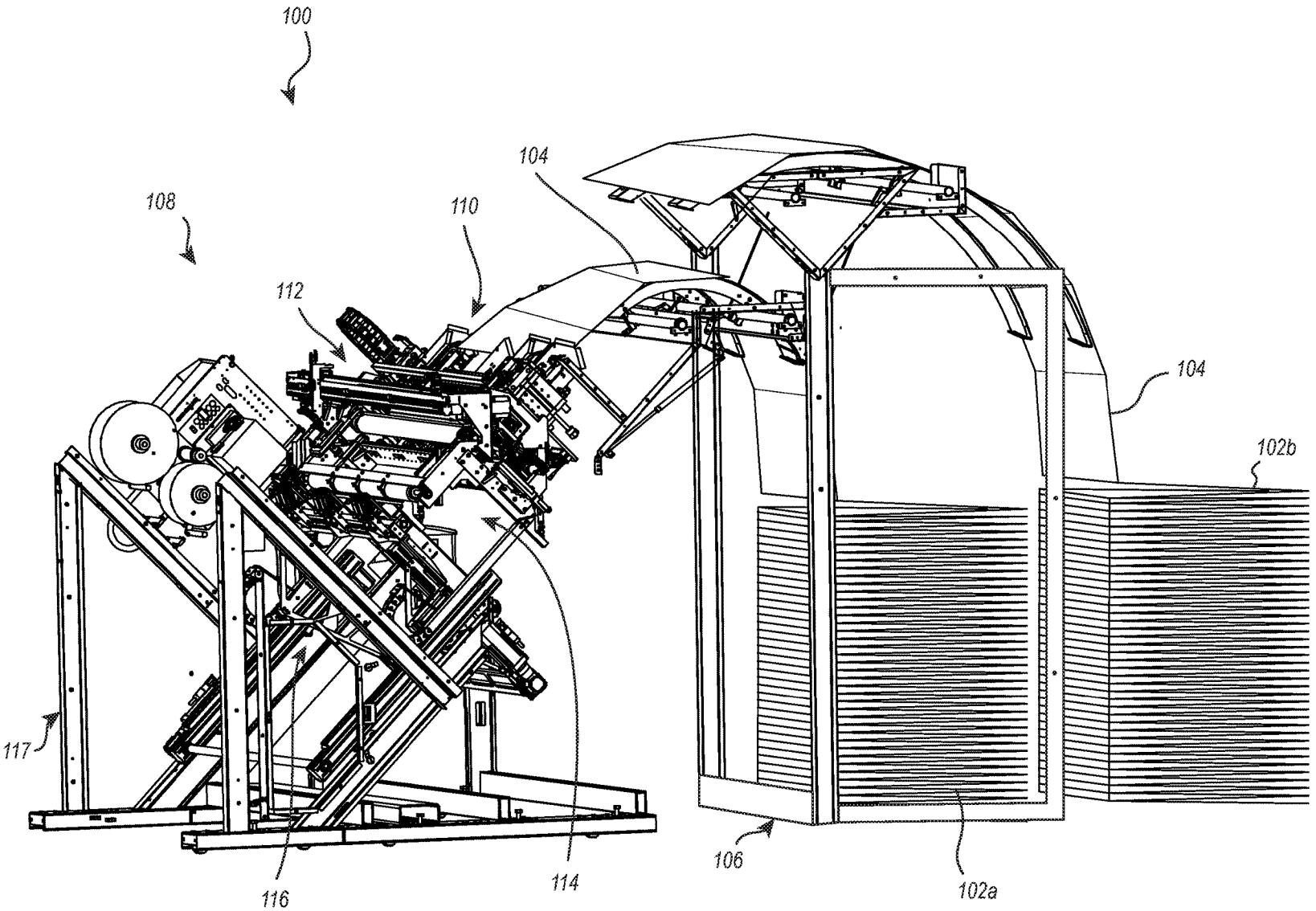
FIG. 1 illustrates a box template forming machine as part of a system for forming boxes from sheet material.

Exemplary embodiments of the disclosure relate to systems, methods, and devices for erecting box templates into boxes. More specifically, the described embodiments relate to box erecting machines that take a previously formed box template (with the manufacturer's joint already formed) and erect a box therefrom and close at least the bottom flaps thereof with minimal or no manual labor required.

While the present disclosure will be described in detail with reference to specific configurations, the descriptions are illustrative and are not to be construed as limiting the scope of the present invention. Various modifications can be made to the illustrated configurations without departing from the spirit and scope of the invention as defined by the claims.

As used herein, the term "bale" shall refer to a stock of sheet material that is generally rigid in at least one direction, and may be used to make a box template. For example, the bale may be formed of a continuous sheet of material or a sheet of material of any specific length, such as paperboard, corrugated cardboard, and cardboard sheet materials. Additionally, the bale may have stock material that is substantially flat, folded, or wound onto a bobbin.

As used herein, the term "box template" shall refer to a substantially flat stock of material that can be erected into a box-like shape. A box template may have notches, cutouts, divides, and/or creases that allow the box template to be bent and/or folded into a box. The notches, cutouts, divides, and/or creases in the box template may at least partially define various panels and/or flaps that will forms the sides, top, and bottom of a box formed from the box template. Additionally, a box template may be made of any suitable material, generally known to those skilled in the art. For example, cardboard or corrugated paperboard may be used as the box template material. A suitable material also may have any thickness and weight that would permit it to be bent and/or folded into a box-like shape.

As used herein, the term "un-erected box" shall refer to a box template that has been folded one or more times and a manufacturer's joint has been formed thereon. For example, a box template may be folded along one or more creases to bring the opposing ends of the box template together. A manufacturer's joint may be formed between the opposing ends of the box template. For instance, the opposing ends of the box template may be glued, taped, or stapled together.

As used herein, the term "crease" shall refer to a line along which the box template may be folded. For example, a crease may be an indentation in the box template material, which may aid in folding portions of the box template separated by the crease, with respect to one another. A suitable indentation may be created by applying sufficient pressure to reduce the thickness of the material in the desired location and/or by removing some of the material along the desired location, such as by scoring.

The terms "notch," "cutout," and "cut" are used interchangeably herein and shall refer to a shape created by removing material from the template or by separating portions of the template, such that a divide through the template material is created.

FIG. 1 illustrates a perspective view of a system 100 that may be used to create un-erected boxes. The system 100 includes bales 102*a*, 102*b* of sheet material 104. The system 100 also includes a feed assembly 106 that helps direct the sheet material 104 into a box template forming machine 108. The box template forming machine 108 includes a feed changer 110, a converter assembly 112, a fold assembly 114, and an attachment assembly 116. The feed changer 110, converter assembly 112, fold assembly 114, and attachment assembly 116 are mounted on or connected to a frame 117.

A box forming machine similar or identical to box template forming machine 108 is described in U.S. patent application Ser. No. 15/616,688, filed Jun. 7, 2017, and entitled Box Forming Machine (the "'688 application"), which is incorporated herein by reference in its entirely. As described in the '688 application, the converter assembly 112 may perform one or more conversion functions on sheet material 104 to transform the sheet material into box templates. The conversion functions may include forming cuts, creases, scores, notches, or the like in the sheet material 104. The fold assembly 114 may fold the box template (e.g., between second and third sidewall sections thereof) to bring opposing ends of the box template together. The attachment assembly 116 may attach the opposing ends of the box template together so as to form a manufacturer's joint. With the manufacturer's joint formed, the box template becomes an "un-erected box".

Figure 2A:
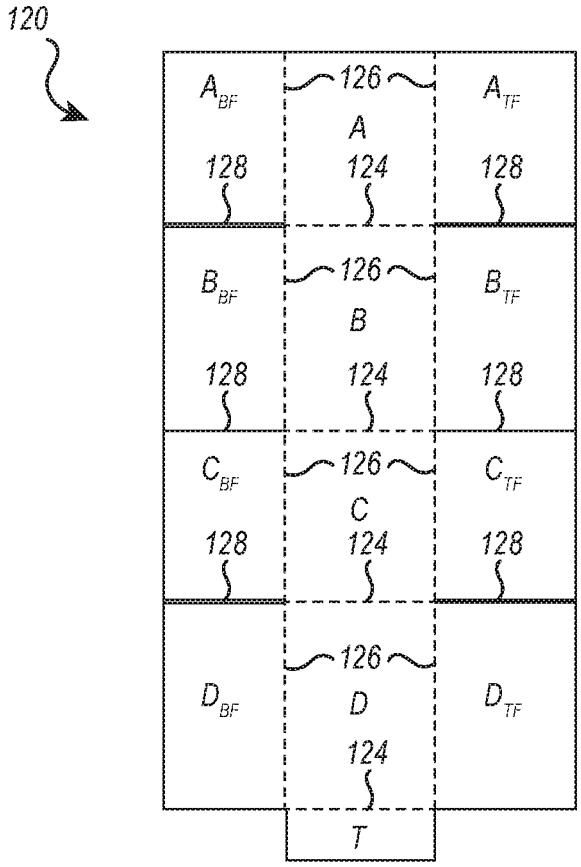
FIG. 2A illustrates a box template.
Figure 2B:
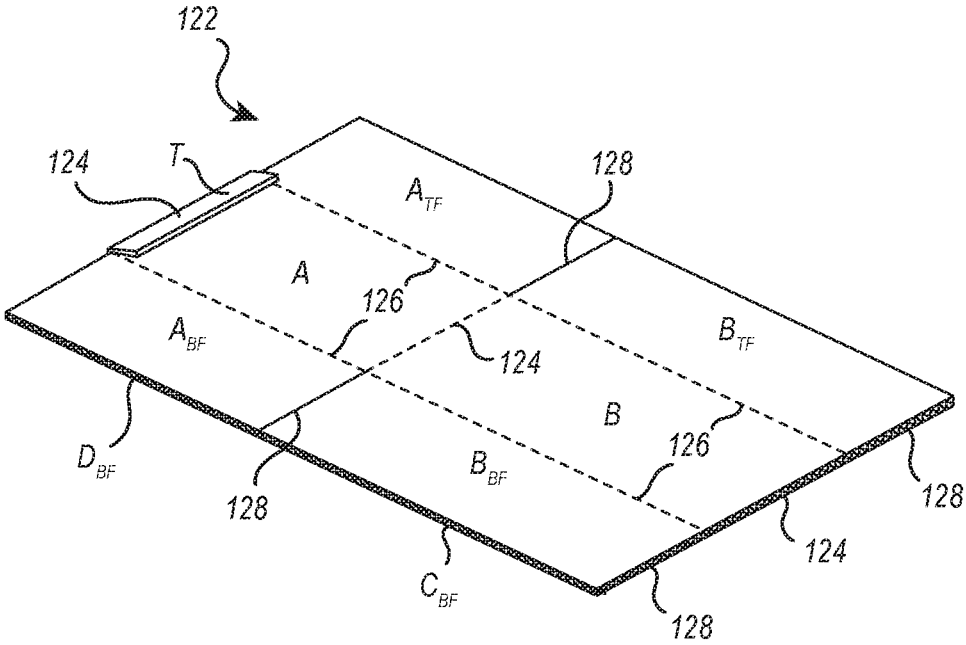
FIG. 2B illustrates the box template of FIG. 2A folded with a manufacturer's joint formed to make an un-erected box.
Figure 3:
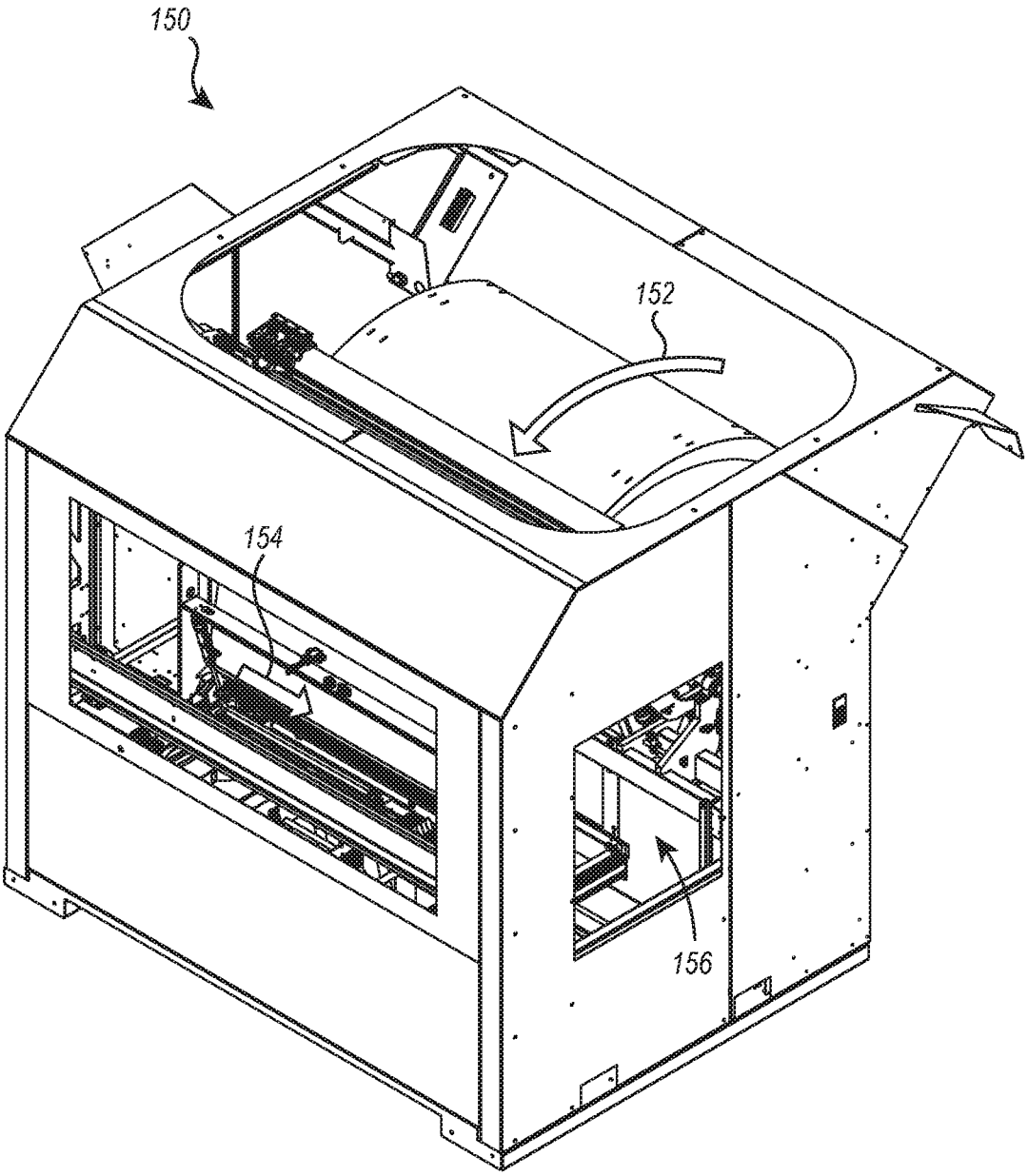
FIG. 3 illustrates a box erecting machine for erecting un-erected boxes formed with the box template forming machine of FIG. 1.

FIGS. 2A and 2B illustrate one example of a box template 120 and an un-erected box 122 formed from the box template 120. In the illustrated embodiment, the box blank 120 includes first, second, third, and fourth side-by-side panels (also referred to as sidewall panels), designated as A, B, C, and D, and a glue tab T. The panels A-D may form the sidewalls of a box formed from the box template 120. Panels A-D and glue tab T are separated by creases or scores 124 (illustrated by dashed lines). The box blank also includes first, second, third, and fourth top flaps $A_{TF}$, $B_{TF}$, $C_{TF}$, $D_{TF}$ and first, second, third, and fourth bottom flaps $A_{BF}$, $B_{BF}$, $C_{BF}$, $D_{BF}$. The top and bottom flaps extend from opposing sides of their corresponding panels and are separated therefrom by creases or scores 126 (illustrated by dashed lines). Each of the flaps is separated from an adjacent flap by a cut or notch 128 (illustrated by solid lines between adjacent flaps).

In some embodiments, the width of the box formed with un-erected box 122 corresponds to the length of each of panels A and C (e.g., the lengths of panels A, C are the distances across panels A, C between panels B, D). To close the bottom of the box formed with un-erected box 122, bottom flaps $B_{BF}$, $D_{BF}$ may each have a dimension that is equal to about half of the length of panels A, C (e.g., half of the width of the box). For instance, the dimension of bottom flap $B_{BF}$ between crease 126 and an edge of bottom flap $B_{BF}$ opposite panel B may be equal to half of the length of panels A, C or the width of the box formed with un-erected box 122.

The box template forming machine 108 can form the cuts and creases in the sheet material 104 in order to form box template 120. Additionally, the box template forming machine 108 can also fold the box template 120 and secure opposing ends thereof together to form un-erected box 122. For instance, box template forming machine 108 can fold box template 120 along crease 124 between second and third panels B and C, as shown in FIG. 2B. The box template forming machine 108 can also secure glue tab T to panel A (e.g., with glue, tape, staples, or the like) to form a manufacturer's joint.

Typically, an un-erected box 122 would be retrieved by an operator and manually erected, filled, and closed. FIGS. 3-31 illustrate processes and a box erecting machine 150 that can reduce the amount of manual labor involved with erecting and closing an un-erected box 122. Generally, an un-erected box 122 may be delivered into one side of the box erecting machine 150, move therethrough during the erecting process, and be discharged therefrom as an at least partially erected box.

For instance, an un-erected box 122 may be delivered into a rear side (rear right side in FIG. 3) of the machine 150. The un-erected box 122 may be delivered into the machine 150 by an operator or another machine, such as box template forming machine 108. As the un-erected box 122 moves through machine 150, it will generally follow a path indicated by arrows 152 and 154. As indicated by arrow 152, the un-erected box 122 will be moved from the rear side of machine 150 towards the front side thereof. During that process, the un-erected box 122 may be moved and/or reoriented as will be described in greater detail below. Thereafter, during at least a portion of the process of erecting the un-erected box 122 into a box and closing the bottom flaps thereof, the box may move in the direction of arrow 154 and be discharged out of the machine 150. In the illustrated embodiment, the box is discharged through a discharge opening 156 in a side of the machine 150.

Figure 4:
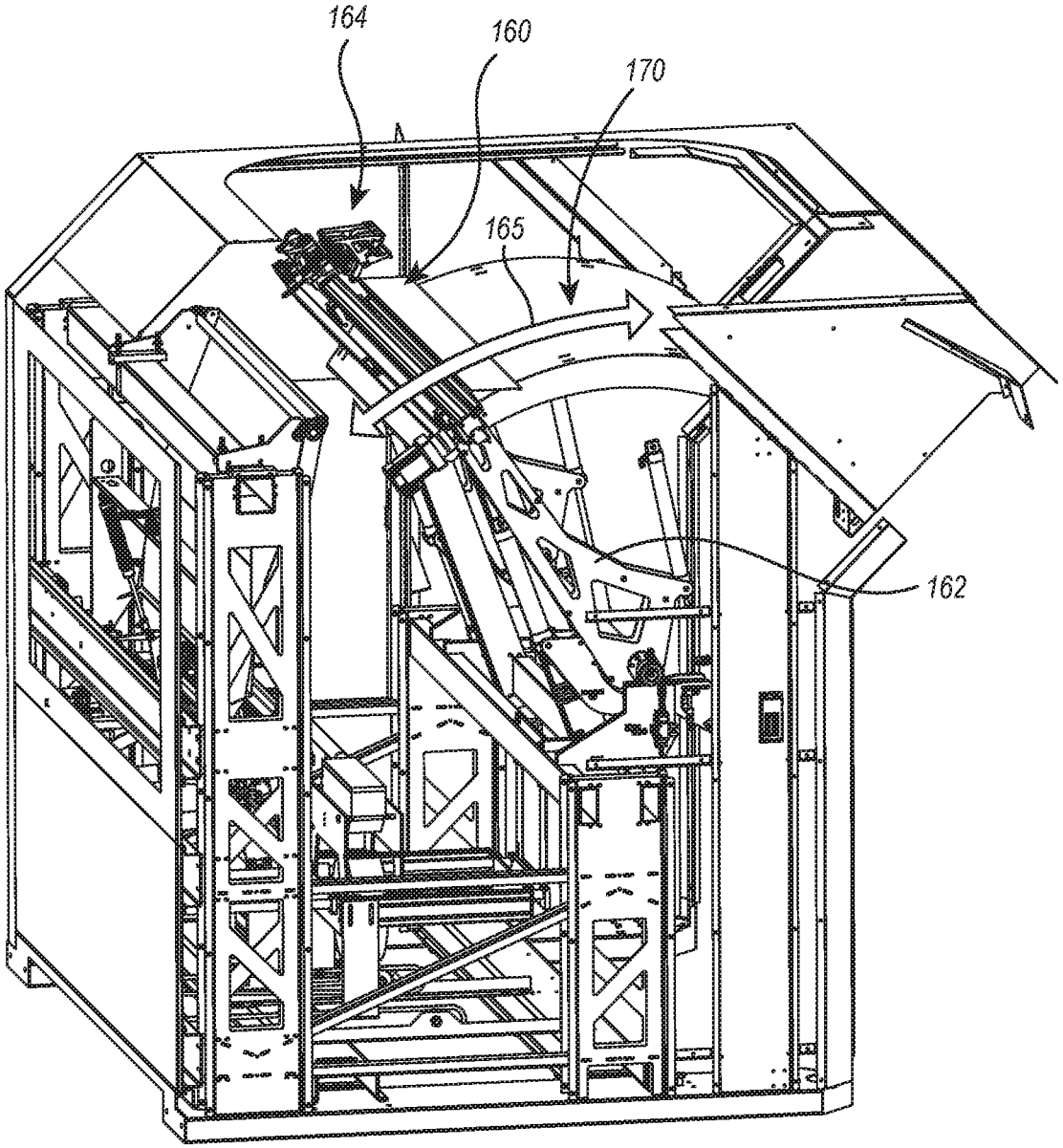
FIGS. 4-10 illustrate a transport mechanism of the box erecting machine of FIG. 3 and an example manner of operation thereof.

As can be seen in FIG. 4, machine 150 includes a transport mechanism 160. Transport mechanism 160 is configured to take hold of the un-erected box 122 when the un-erected box 122 is delivered to machine 150 and transport the un-erected box 122 from the rear side of the machine 150 towards the front side of the machine 150, where the un-erected box 122 can be erected into a box.

In the illustrated embodiment, the transport mechanism 160 includes one or more swing or pivot arms 162 with one or more clamps 164 mounted thereon. The transport mechanism 160 can pivot, swing, or rotate between a rear position and a forward position, as indicated by arrow 165. In the rear position, the clamp 164 is positioned near the rear of machine 150. When an un-erected box 122 is delivered to machine 150, the clamp 164 can clamp onto the un-erected box 122. Thereafter, the transport mechanism 160 may pivot, swing, or rotate towards the forward position near the front of the machine 150.

Figure 5:
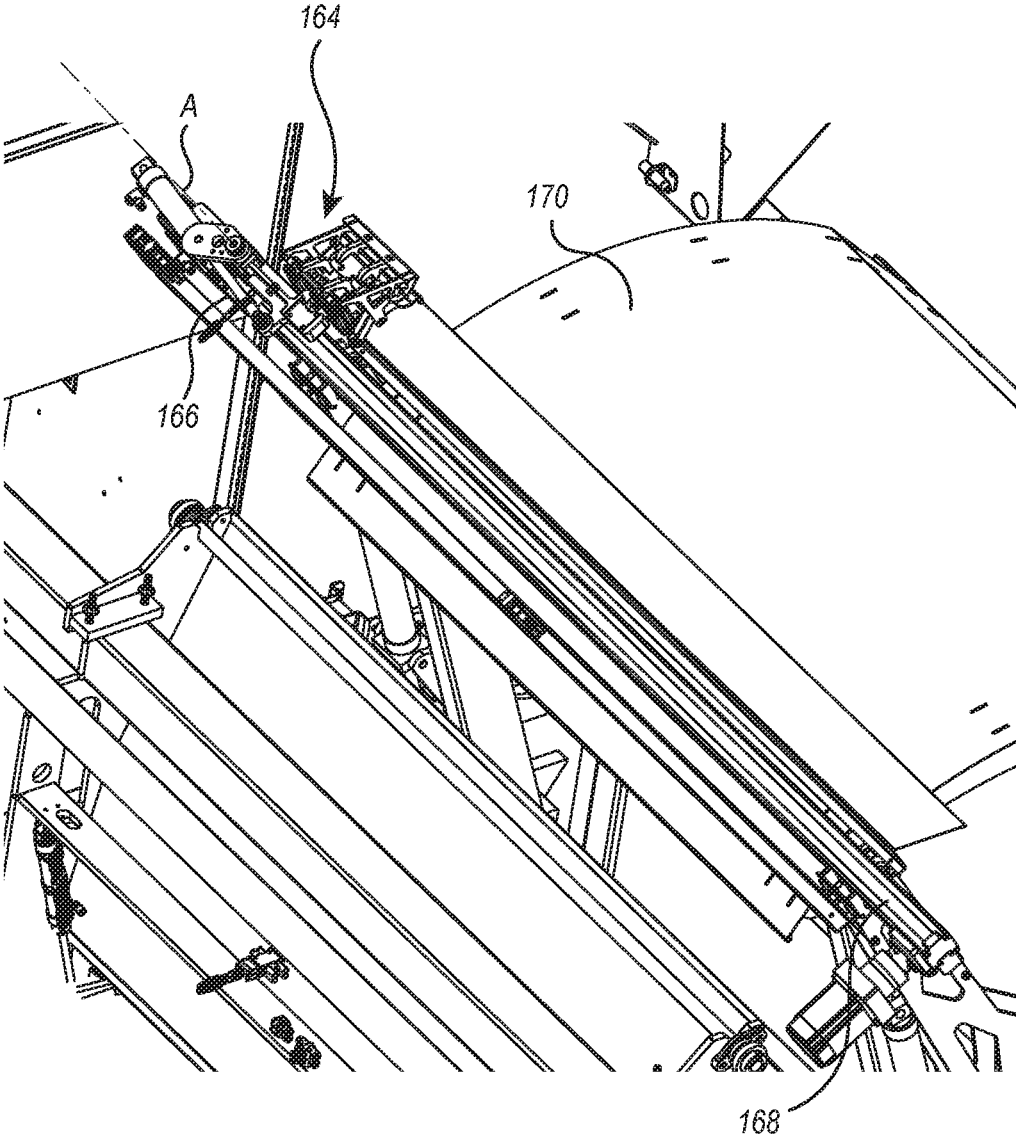

In some embodiments, such as that shown in FIG. 5, the clamp 164 is mounted on a carriage 166. The carriage 166 can move along a track 168 between opposing sides of the machine 150. Additionally, the clamp 164 may be pivotally mounted on the carriage 166 such that the clamp 164 may rotate or pivot about an axis A. In some embodiments, axis A is generally perpendicular to the track 168. The movement of the carriage 166 along the track 168 and the rotation of the clamp 164 about axis A can facilitate positioning of the un-erected box 122 in a desired location and orientation for the box erecting process described in greater detail below.

As illustrated in FIGS. 4 and 5, the transport mechanism 160 may also include a guide plate 170. In the illustrated embodiment, guide plate 170 takes the form of an arcuate or curved panel, but may take other forms in other embodiments. Guide plate 170 is positioned below clamp 164. As clamp 164 moves from the rear position to the forward position with the un-erected box 122, guide plate 164 may provide support to the un-erected box 122.

Figure 6:
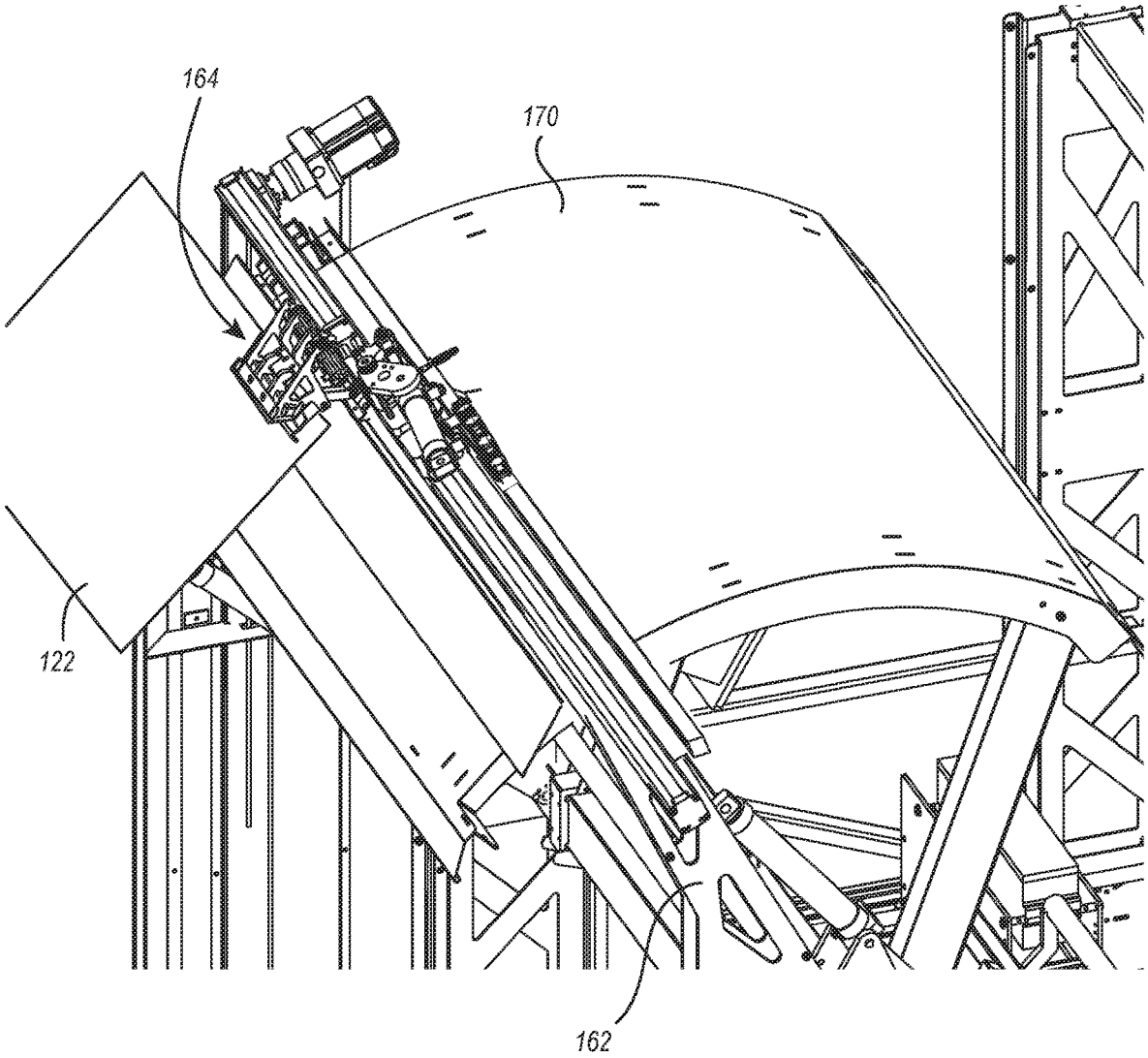

FIGS. 6-10 illustrate transport mechanism 160 moving an un-erected box 122 from the rear of machine 150 to the front of machine 150 in preparation for the process of erecting the un-erected box 122. In FIG. 6, the pivot arm 162 is pivoted towards the rear position. As a result, clamp 164 is positioned to receive and clamp onto an un-erected box 122 when such is delivered to machine 150.

Figure 7:
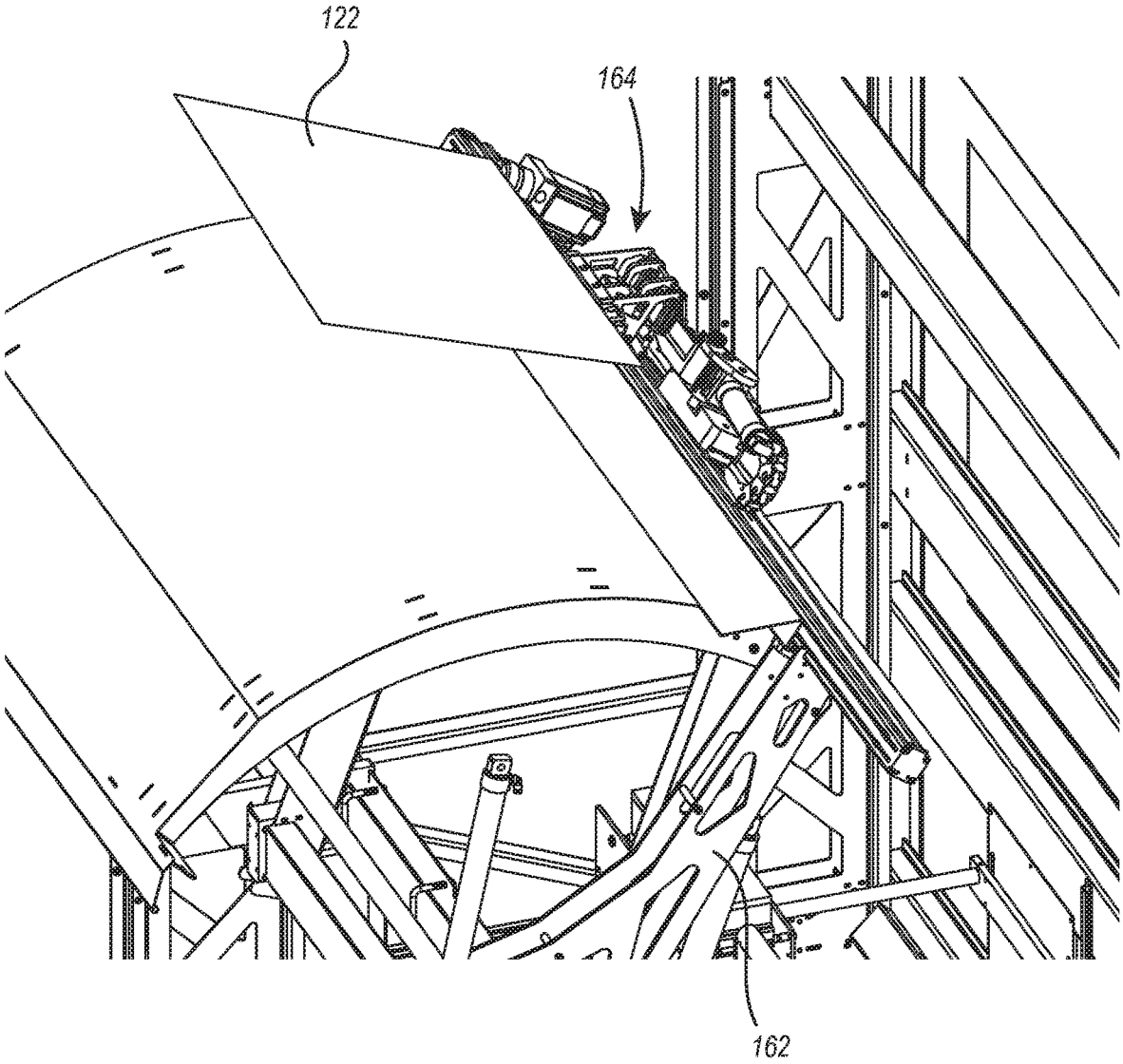
Figure 8:
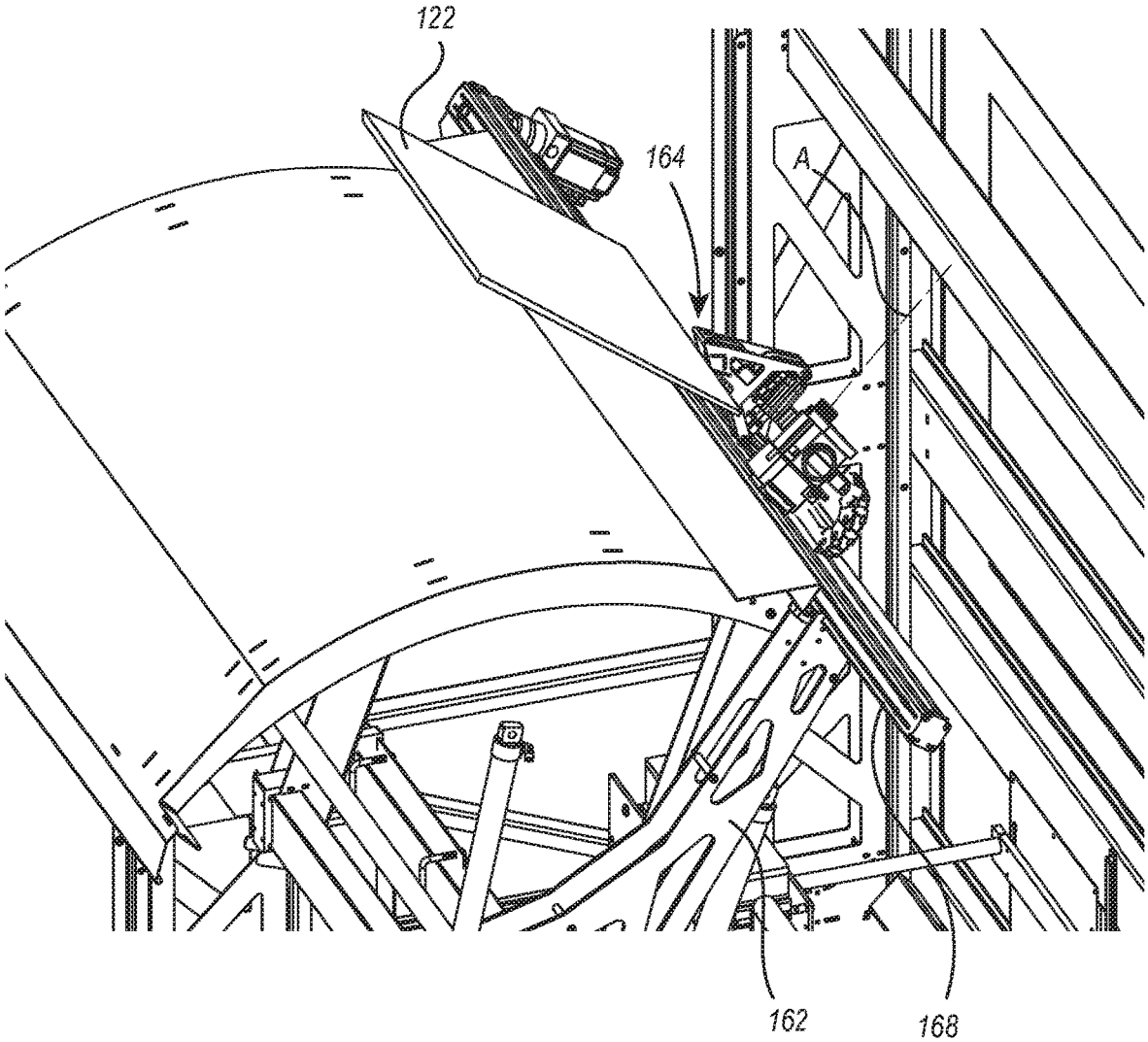
Figure 9:
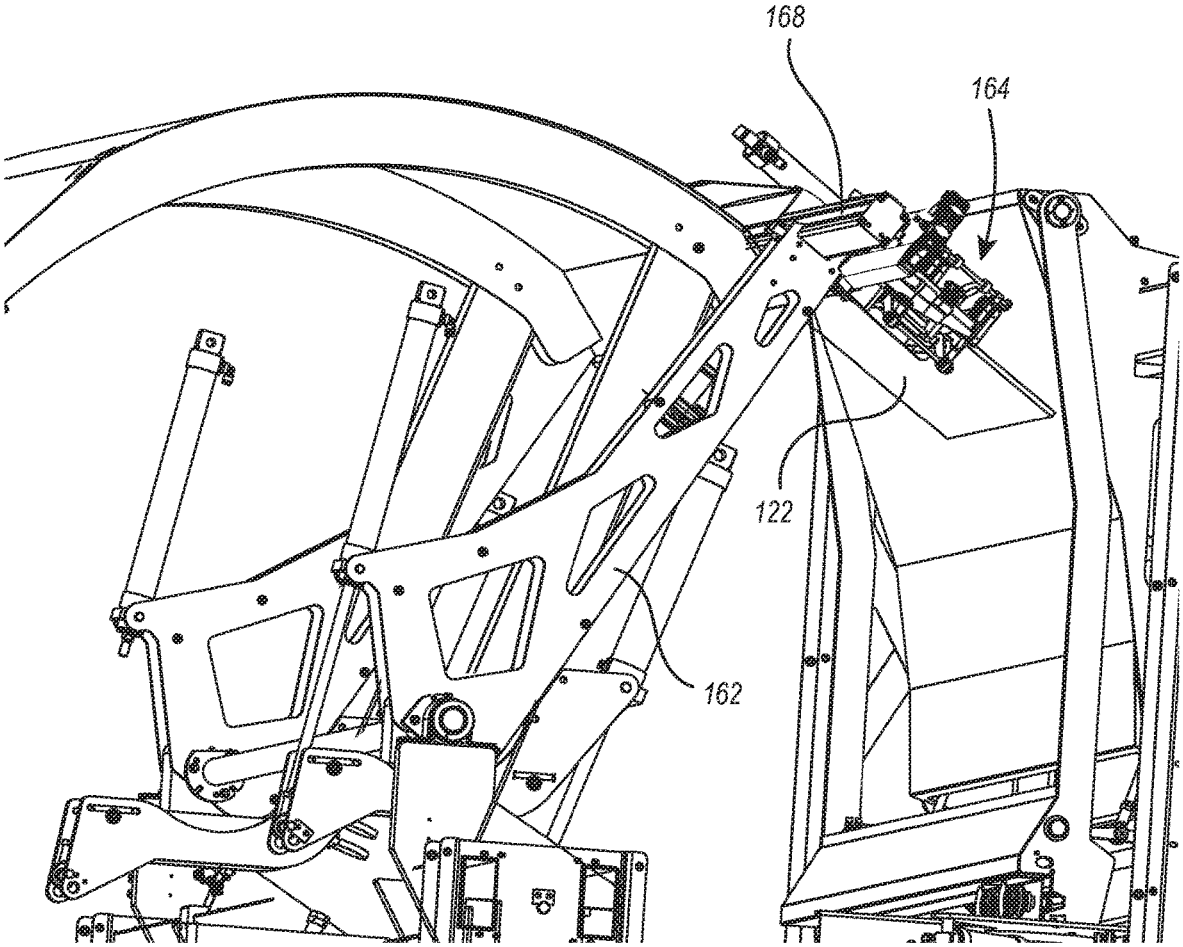
Figure 10:
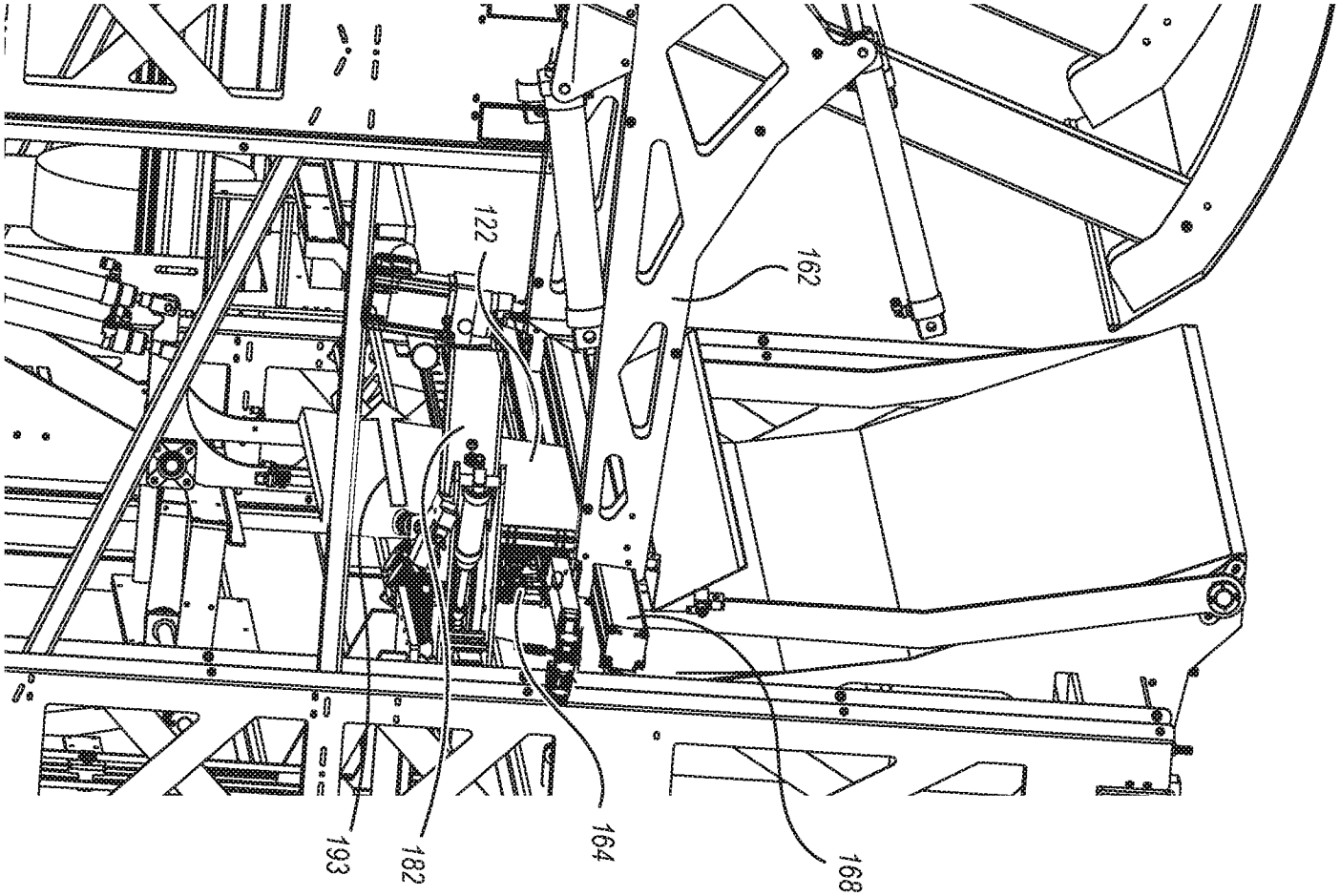

Once clamp 164 has clamped onto an un-erected box 122, transport mechanism 160 can begin to pivot towards the forward position as shown in FIGS. 7-10. As best seen in FIGS. 7-9, while transport mechanism 160 is pivoting towards the forward position, clamp 164 may move along track 168 and also rotate about axis A to reorient un-erected box 122. For example, as illustrated in FIG. 7, clamp 164 is holding onto the manufacturer's joint of un-erected box 122 so that the manufacturer's joint is oriented generally horizontally or parallel to track 168. As a result of the rotation of clamp 164 (and the pivoting of transport mechanism 160) shown in FIGS. 8 and 9, the un-erected box 122 is reoriented so that the manufacturer's joint is oriented generally vertically or perpendicular to track 168, as shown in FIG. 10. In this position and orientation, the un-erected box 122 is generally prepared to be erected into a box. However, as described below, the position of the un-erected box 122 may be further refined prior to the un-erected box 122 being erected into a box.

Figure 11:
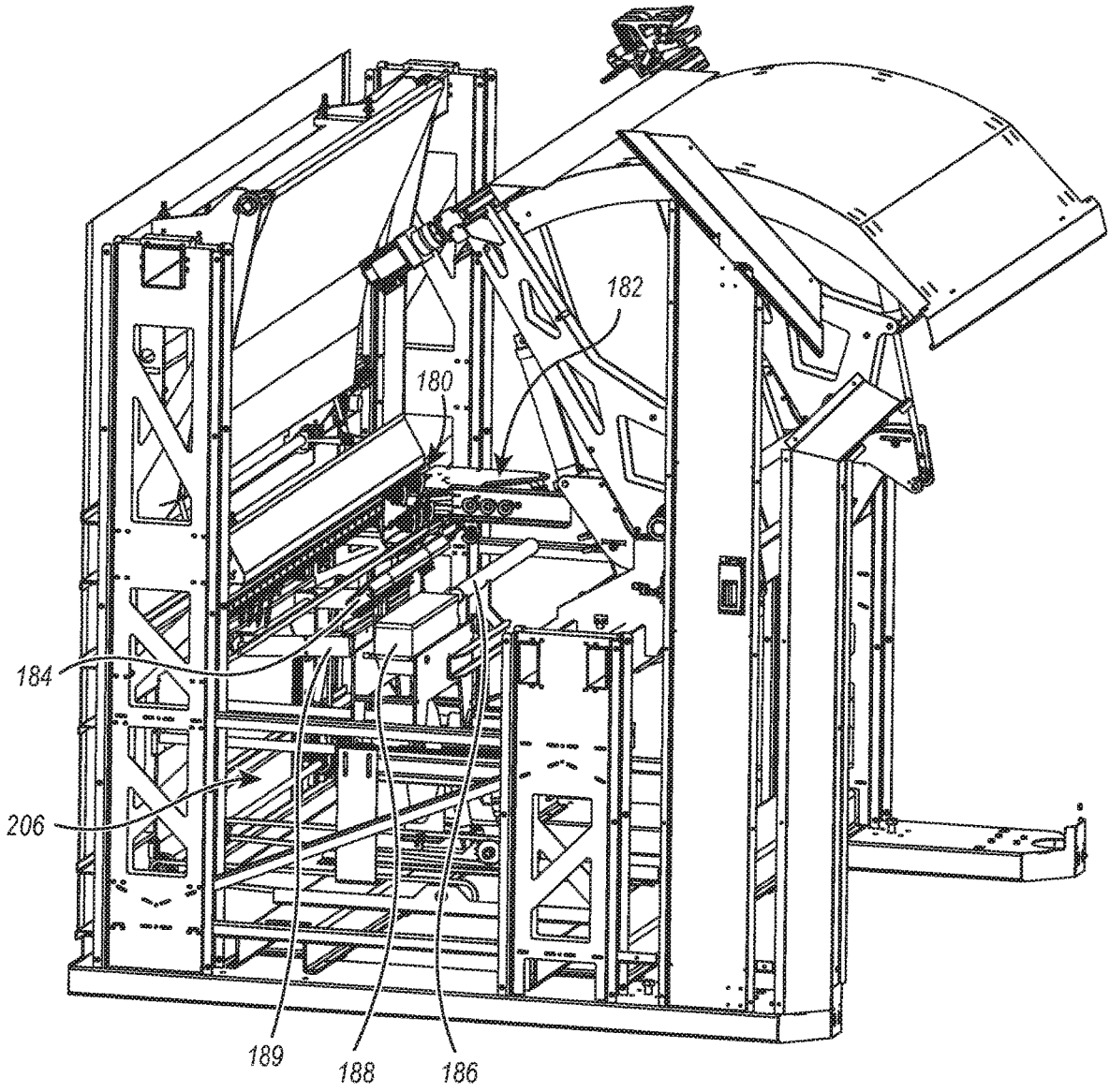
FIGS. 11-23 illustrate a box erecting assembly of the box erecting machine of FIG. 3 and an example manner of operation thereof.
Figure 12:
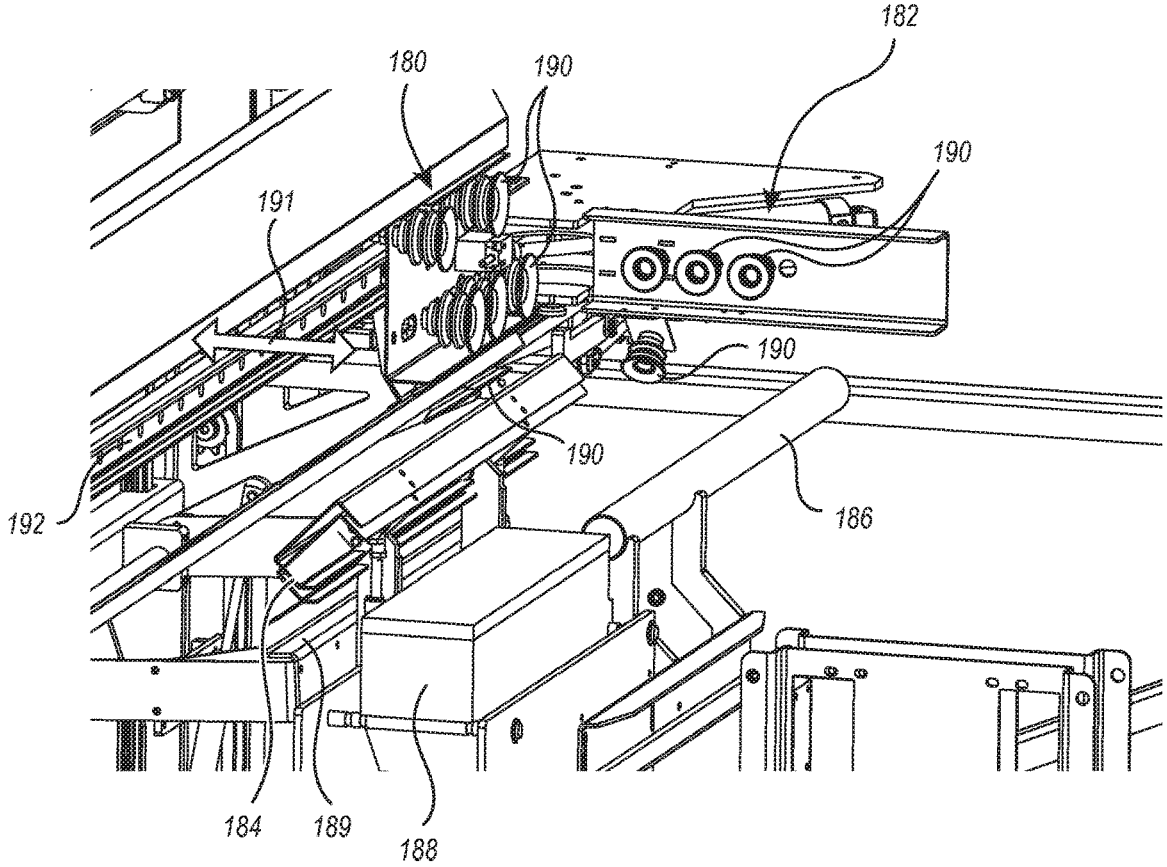
Figure 13:
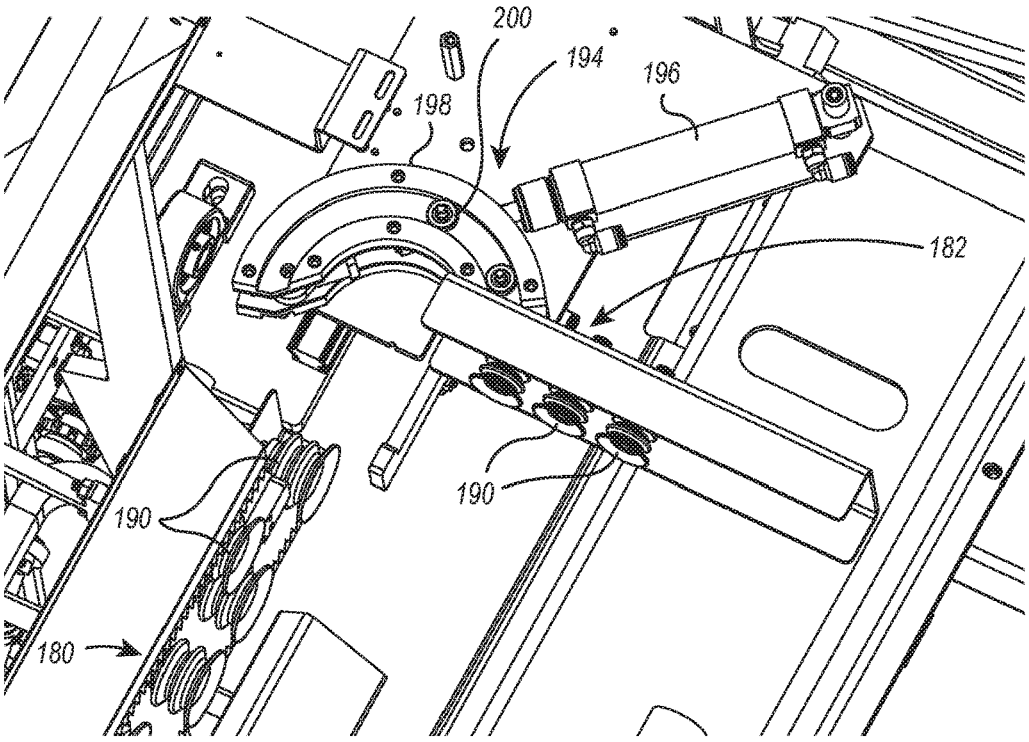

Attention is now directed to FIGS. 11-13, which illustrate a box erecting assembly of machine 150. Erecting a box from an un-erected box 122 includes at least opening or unfolding the flat un-erected box 122 so that the sidewalls A, B, C, D of the un-erected box 122 are arranged into a rectangular tube and then folding closed and securing the bottom flaps $A_{BF}$, $B_{BF}$, $C_{BF}$, $D_{BF}$ thereof.

In the illustrated embodiment, the box erecting assembly includes an opening or unfolding mechanism that includes, among other things, at least first and second vacuum heads 180, 182, a folding mechanism including first and second folding bars 184, 186, and a closure mechanism 188. The box erecting assembly may also include a datum surface 189. As described in more detail below, the datum surface 189 and the second vacuum head 182 may adjust or fine-tune the position of the un-erected box 122 prior to or as part of the process of erecting un-erected box 122 into a box. As also discussed below, the first and second vacuum heads 180, 182 are configured to hold the un-erected box template 122 in a desired position and open or unfold the un-erected box template 122 into a rectangular tube. The first and second folding bars 184, 186 are configured to fold closed at least some of the bottom flaps $A_{BF}$, $B_{BF}$, $C_{BF}$, $D_{BF}$. The closure mechanism 188 is configured to secure the bottom flaps $A_{BF}$, $B_{BF}$, $C_{BF}$, $D_{BF}$ in place in the closed configuration so that the bottom flaps $A_{BF}$, $B_{BF}$, $C_{BF}$, $D_{BF}$ form a bottom surface of a box.

As can be seen in FIGS. 12 and 13, each of the first and second vacuum heads 180, 182 includes a plurality of vacuum cups 190. For instance, the illustrated first vacuum head 180 includes five vertical vacuum heads 190 and two angled vacuum heads 190. Similarly, the illustrated second vacuum head 182 includes three vertical vacuum cups 190 and one angled vacuum cup 190. It will be appreciated that the first and/or second vacuum heads 180, 182 may include fewer or more vacuum cups than illustrated. Additionally, the arrangement of the vacuum cups 190 may vary from one embodiment to another. The purpose of the orientation of the angled vacuum cups 190 will be discussed below.

In any event, the vacuum cups 190 may be connected to a compressor or other mechanism that can enable the vacuum cups 190 to suction onto planar surfaces of an un-erected box 122. In some embodiments, at least some of the vacuum cups 190 may also direct pressurized air towards one or more planar surfaces of an un-erected box 122 to move the surface(s) in a desired direction.

While the present embodiment is described as having vacuum heads with vacuum cups for securing to portions of the un-erected box 122, it will be appreciated that vacuum heads and vacuum cups are merely exemplary. In other embodiments, other types of gripping devices can be used to secure to the un-erected box 122. For instance, attachment heads that include one or more needle grippers or other types of gripper devices could be used to selectively secure to portion of the un-erected box 122. Accordingly, it will be understood that references herein to vacuum heads and vacuum cups are used generally to identify any suitable attachment head with one or more gripper devices.

As can be seen in FIG. 12, the first vacuum head 180 can be mounted on a track 192. First vacuum head 180 can move back and forth along track 192 at least partially between opposing sides of machine 150. For instance, as discussed in greater detail below, first vacuum head 180 can move along track 192 in order to move a partially erected box towards closure mechanism 188 and a completed box towards discharge opening 156 (e.g., in the direction of arrow 154, FIG. 3). In some embodiments, track 192 is generally parallel with track 168.

Additionally, in some embodiments, vacuum head 180 (and optionally tract 192) may pivot or move horizontally in the directions indicated by arrow 191. For instance, when the transport mechanism 190 is delivering the un-erected box 122 to the erecting assembly as shown in FIGS. 8-10, the vacuum head 180 may pivot or move away from the transport mechanism 190 (e.g., away from the rear and towards the front of machine 150). Such movement of vacuum head 180 can provide clearance for the un-erected box 122 so that the lower end thereof does not get caught on the vacuum head 122. Once the un-erected box 122 is in a generally vertical position as shown in FIG. 10, vacuum head 180 can pivot or move back towards the transport mechanism 190 (e.g., towards the rear and away from the front of machine 150). Such movement can position (at least the vertical) vacuum cups 190 of vacuum head 180 adjacent to the un-erected box 122.

Second vacuum head 182 can also move. More specifically, second vacuum head 182 may move in the direction indicated by arrow 193 in FIG. 10 (which can be generally parallel to track 192). For instance, when un-erected box 122 is brought to the position shown in FIG. 10, second vacuum head 182 may move in the direction of arrow 193 to engage and move un-erected box 122 to a predetermined horizontal position.

At the same or similar time, the datum surface 189 (FIG. 11) may move up underneath the un-erected box 122. The datum surface 189 may engage the bottom edge of the un-erected box 122 and push the un-erected box 122 up to a predetermined vertical position. The datum surface 189 may also support the un-erected box 122 from underneath during the transition from the clamp 164 to the vacuum heads 180, 182 described below. Engagement of the datum surface 189 with the lower edge of the un-erected box 122 may also ensure that the bottom edge of the un-erected box 122 (and thus the un-erected box 122) is oriented horizontally.

In some embodiments, the fine-tuned positioning of the un-erected box 122 via the second vacuum head 182 and the datum surface 189 may be related to the width of the box being formed from the un-erected box 122. For instance, the datum surface 189 may engage and move the un-erected box 122 up based on the width of the box. More specifically, the datum surface 189 may move the un-erected box 122 up so that the creases 126 between the bottom flaps and the sidewalls of the un-erected box 122 are at a predetermined vertical position. Similarly, the second vacuum head 182 may move the un-erected box 122 horizontally to a predetermined position, which may be based on the width of the box.

Once the un-erected box 122 is positioned and oriented as described, the securement of the un-erected box 122 may transition from the clamp 164 to the vacuum heads 180, 182. For instance, substantially simultaneously or in a predetermined order, the clamp 164 may release its grip on the un-erected box 122 and the vacuum heads 180, 182 may be secured to the un-erected box 122. In one embodiment, once the clamp 164 has released the un-erected box 122, the second vacuum head 182 may pivot between the first position illustrated in FIGS. 12 and 13 and the second position illustrated in FIGS. 14-17. In the first position, the second vacuum head 182 is oriented generally perpendicular to first vacuum head 180. In contrast, in the second position, the second vacuum head 182 is oriented generally parallel to first vacuum head 180. When second vacuum head 182 is oriented generally parallel to first vacuum head 180, the vertical vacuum cups 190 of the vacuum heads 180, 182 generally face one another or face opposing directions. Prior to or once the vacuum heads 180, 182 are so positioned, the vacuum cups 190 can be activated to secure to the sidewalls of the un-erected box 122.

As shown in FIG. 13, an actuator 194 may pivot the second vacuum head 182 between the two noted positions. In the illustrated embodiment, the actuator 194 includes a piston 196 and a pivot arm 198. As the piston rod extends and retracts, it pushes and pulls on the pivot arm 198. The pivot arm 198 cooperates with rollers 200 that direct the pivot arm 198 to move through an arcuate path, which causes the second vacuum head 182 to pivot between the noted positions.

Figure 14:
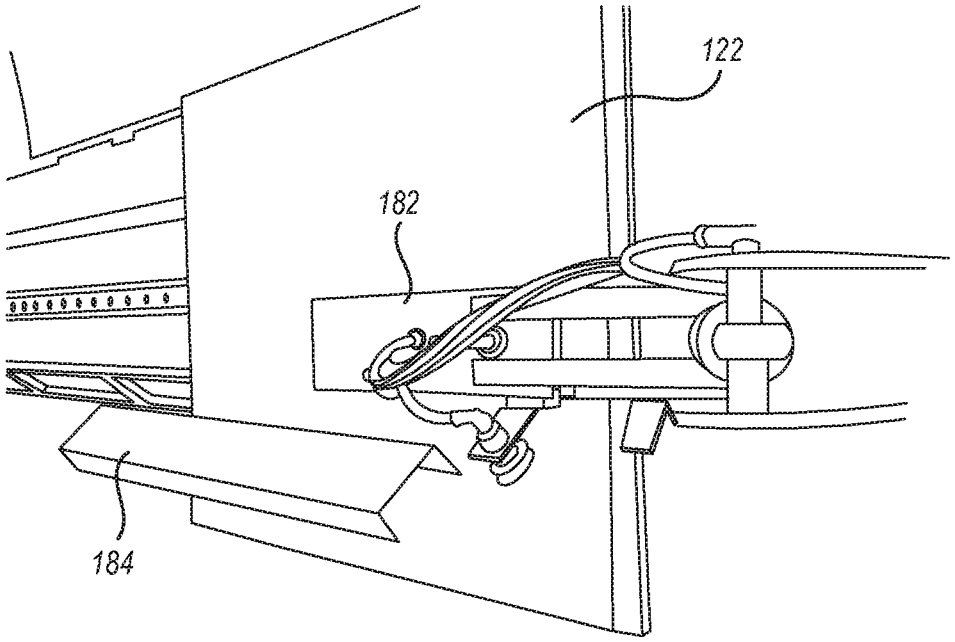

Attention is now directed to FIGS. 14-23, which illustrate the process of erecting a box from an un-erected box 122. In FIG. 14, the un-erected box 122 has been delivered by the transport mechanism 160 to the box erecting assembly. The second vacuum head 182 has been pivoted towards the un-erected box 122 so that the un-erected box 122 is disposed or sandwiched between the first and second vacuum heads 180, 182. At least some of the vacuum cups 190 of the first and second vacuum heads 180, 182 can be activated to secure the un-erected box 122 to the first and second vacuum heads 180, 182.

Figure 15:
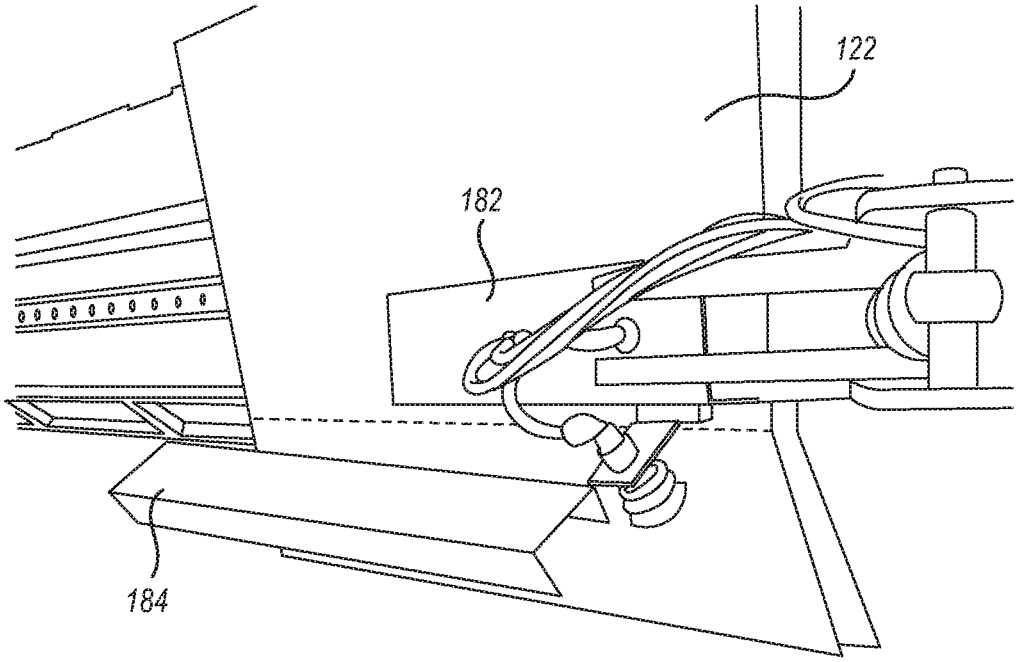
Figure 17:
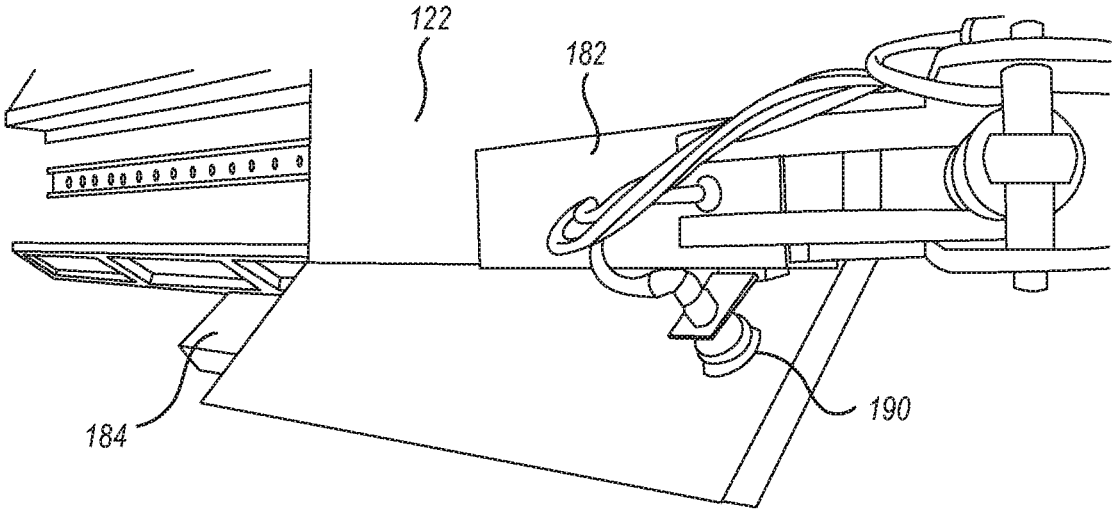

With the un-erected box 122 secured between the first and second vacuum heads 180, 182, the first folding bar 184 can engage the bottom flaps of the un-erected box 122, as shown in FIGS. 15 and 17. More specifically, the first folding bar 184 can fold at least some of the bottom flaps (all of the bottom flaps are folded in the illustrated embodiment) relative to the side panels (e.g., along the creases 126 therebetween) in a first direction as shown in FIG. 15. Thereafter, the first folding bar 184 can optionally fold some of the bottom flaps relative to the side panels in a second direction as shown in FIG. 17. The second direction can be opposite the first direction.

Figure 16:
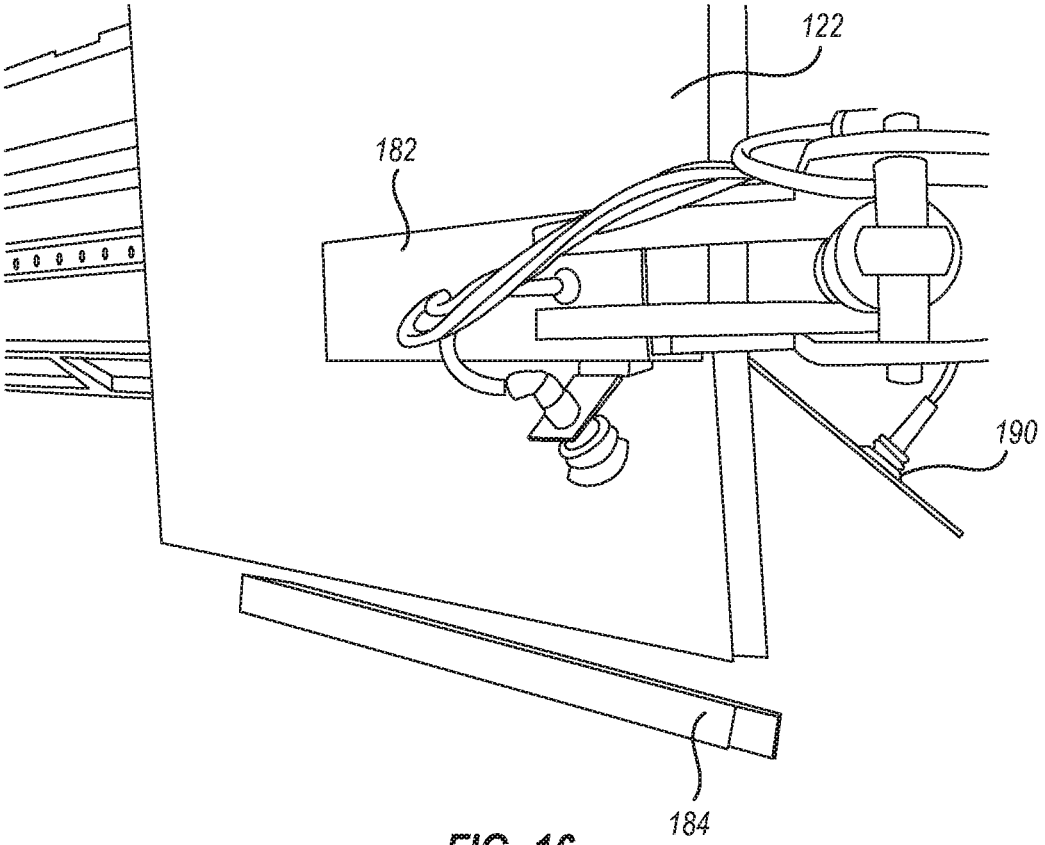

Folding the bottom flaps as described can provide various benefits. For instance, any creases or folds extending through the sidewall panels and flaps (e.g., folds from the sheet material 104 being folded into a bale 102) can be unfolded or flattened by folding the flaps in a direction (or about an axis that is) perpendicular to the orientation of the undesired folds. Additionally, folding the bottom flaps can bring at least some of the bottom flaps into contact with the angled vacuum cups 190 of the first and second vacuum heads 180, 182. For instance, when the first folding bar 184 folds the bottom flaps as shown in FIG. 15, at least one of the bottom flaps engages and is secured to the angled vacuum cup 190 of the first vacuum head 180. As a result, that flap can be held in place (in an angled orientation) as shown in FIGS. 16 and 17. Holding this bottom flap in an angled orientation can maintain the flap and associated sidewall in flat configurations and assist with the process for folding the bottom flaps closed.

Similarly, when the first folding bar 184 folds some or all of the remaining bottom flaps as shown in FIG. 17, at least one of the bottom flaps engages and is secured to the angled vacuum cup 190 of the second vacuum head 182. As a result, that flap can be held in place (in an angled orientation) as shown in FIG. 17. Holding this bottom flap in an angled orientation can maintain the flap and associated sidewall in flat configurations.

Figure 18:
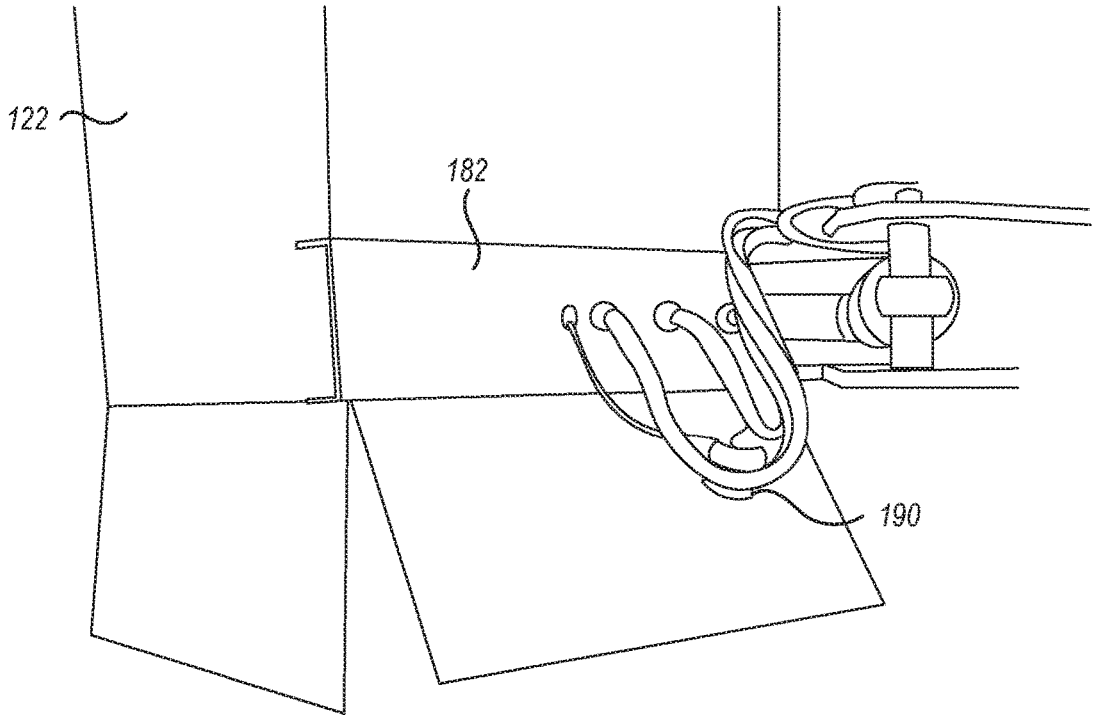

The second vacuum head 182 can then be pivoted to the orientation shown in FIG. 18 (e.g., so that the first and second vacuum heads 180, 182 are arranged at a 90° angle relative to one another). As a result of the negative pressure connection between the vacuum cups 190 of the first and second vacuum heads 180, 182, the un-erected box 122 is opened or unfolded as shown when the second vacuum head 182 is pivoted to the position shown. More specifically, the pivoting of the second vacuum head 182 opens or unfolds the un-erected box 122 so that the sidewalls thereof form of a generally rectangular tube, as shown in FIG. 18.

While the un-erected box 122 is opened or unfolded into the rectangular tube, the first folding bar 184 may remain in the position shown in FIG. 17. During the opening or unfolding of the un-erected box 122 into the rectangular tube, the first folding bar 184 remains engaged with the bottom leading minor flap of the un-erected box 122 (i.e., the bottom minor flap opposite to the angled bottom flap seen in FIG. 18). This engagement causes the bottom leading minor flap to be at least partially folded up towards a closed position. Once the un-erected box 122 is opened or unfolded into the rectangular tube, the first folding bar 184 (or a portion thereof) may move or pivot upwards to fold the bottom leading minor flap to a completely closed position (e.g., so that the flap forms a generally 90° angle with its corresponding side panel).

Figure 19:
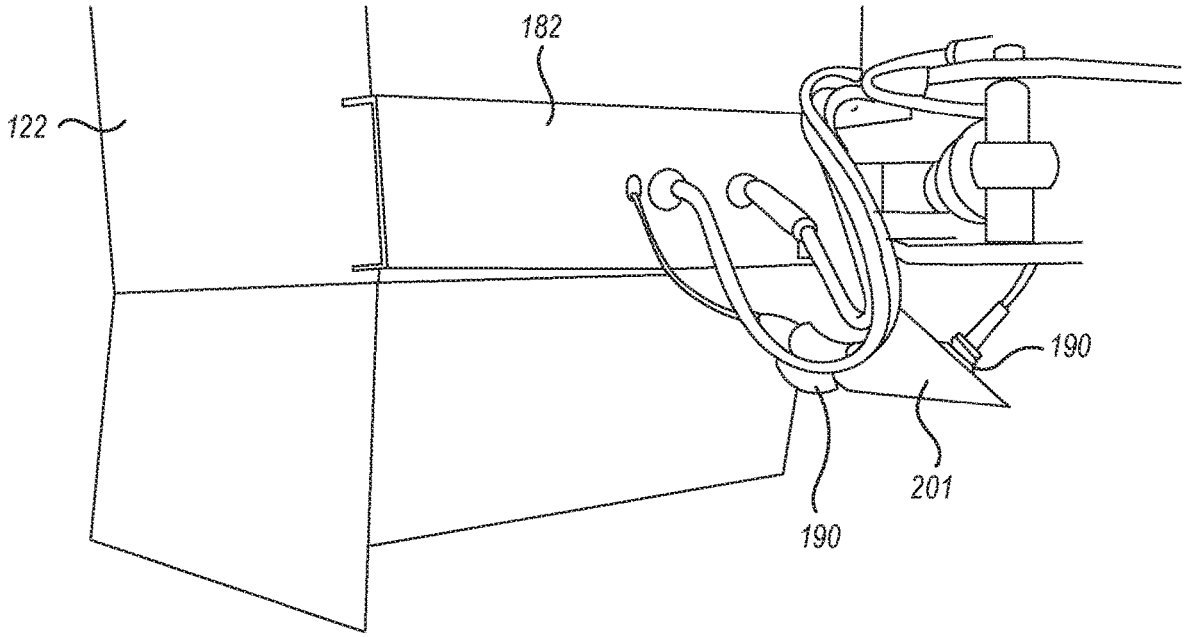

With the un-erected box 122 arranged in a generally rectangular tube, the bottom trailing minor flap thereof (i.e., the flaps below the second vacuum head 182) can be disengaged from the angled vacuum cup 190 thereof, as shown in FIG. 19. Thereafter, a folding bar 201 may be extended to fold the bottom trailing minor flap up to a closed or horizontal position.

Figure 20:
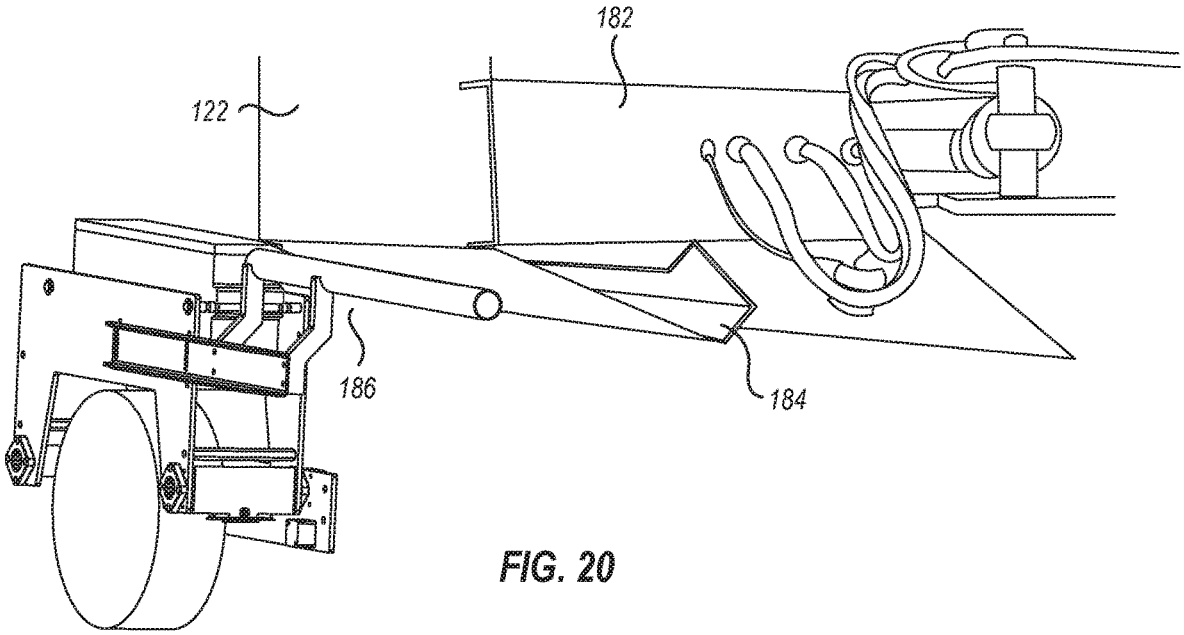
Figure 21:
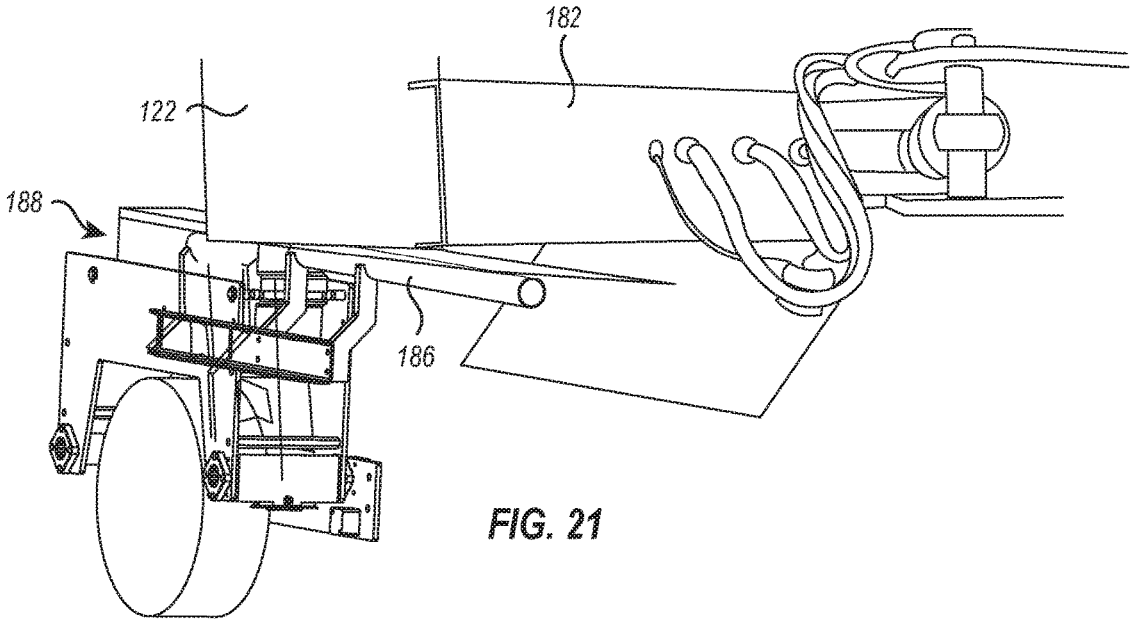
Figure 22:
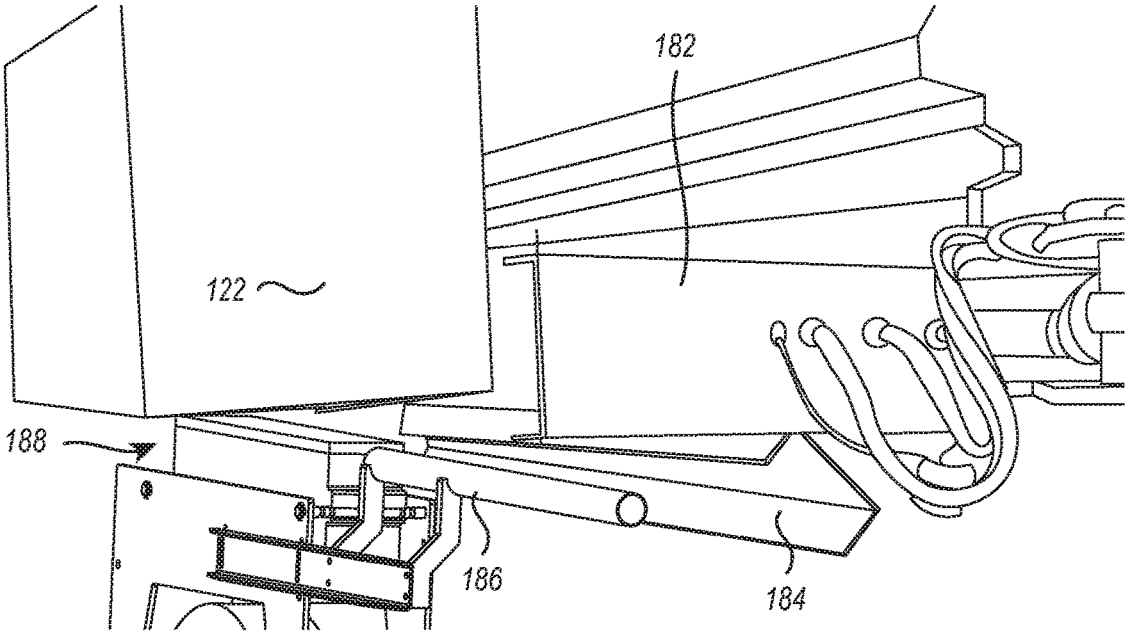

As shown in FIGS. 20-22, the first and second folding bars 184, 186 may then be moved (e.g., pivoted, translated, etc.) to fold the bottom major flaps up to closed or horizontal positions. More specifically, the second folding bar 186 may move towards and engage an outer surface of one of the bottom major flaps to fold the bottom major flap towards a closed position, as shown in FIGS. 20 and 21. Additionally, the first folding bar 184 may pivot or move outside of the bottom flap that is secured to the angled vacuum cup 190 of the first vacuum head 180. The angled vacuum cup 190 of the first vacuum head 180 may disengage the bottom flap and the first folding bar 184 may move towards and engage an outer surface of the bottom major flap to fold the bottom major flap towards a closed position, as shown in FIGS. 20 and 21. In some embodiments, such as that shown in FIG. 22, the first folding bar 184, or a portion thereof, may also move or pivot upward to fully fold the bottom major flap to the closed position. Additionally, in some embodiments, the bottom major flaps are folded in a predetermined order, while in other embodiments the bottom major flaps are folded substantially simultaneously.

Once the bottom flaps are folded closed, the connection between the second vacuum head 182 and the box 122 can be released. The box 122 can then be moved towards the closure mechanism 188. The box 122 can be moved towards the closure mechanism 188 by the first vacuum head 180. More specifically, first vacuum head 180 can move along track 192 towards the closure mechanism 188. Because the first vacuum head 180 is connected to the box 122 (e.g., via vacuum heads 190 thereof), movement of the first vacuum head 180 causes the box 122 to move as well.

In some embodiments, such as that shown in FIG. 22, the first and second folding bars 184, 186 can remain positioned under the box after folding the bottom major flaps closed and while the box is moved towards the closure mechanism 188. In such positions, the first and second folding bars 184, 186 in essence form a track on which the box 122 can move. Additionally, the first and second folding bars 184, 186 also hold the bottom flaps in the closed position until the closure mechanism 188 has secured the bottom flaps closed.

In the illustrated embodiment, the closure mechanism 188 is a tape head that applies tape to at least the bottom major flaps (and optionally at least a portion of opposing sides) of the box 122 to secure the bottom flaps closed. In other embodiments, the closure mechanism 188 may take the form of a glue applicator or stapler than can apply glue or staples to the bottom flaps to secure them closed.

Regardless of the type of closure mechanism used, the closure mechanism 188 cam be movable. For instance, the closure mechanism can move at least partially between the front and rear ends of the machine 150 in order to align the closure mechanism 188 with a bottom seam on the box formed by the bottom major flaps. More specifically, the location of the bottom seam will vary depending on the width of the box. Accordingly, the position of the closure mechanism 188 is adjustable so that the closure mechanism 188 can apply tape, glue, staples, or other fasteners to the bottom seam.

Figure 24:
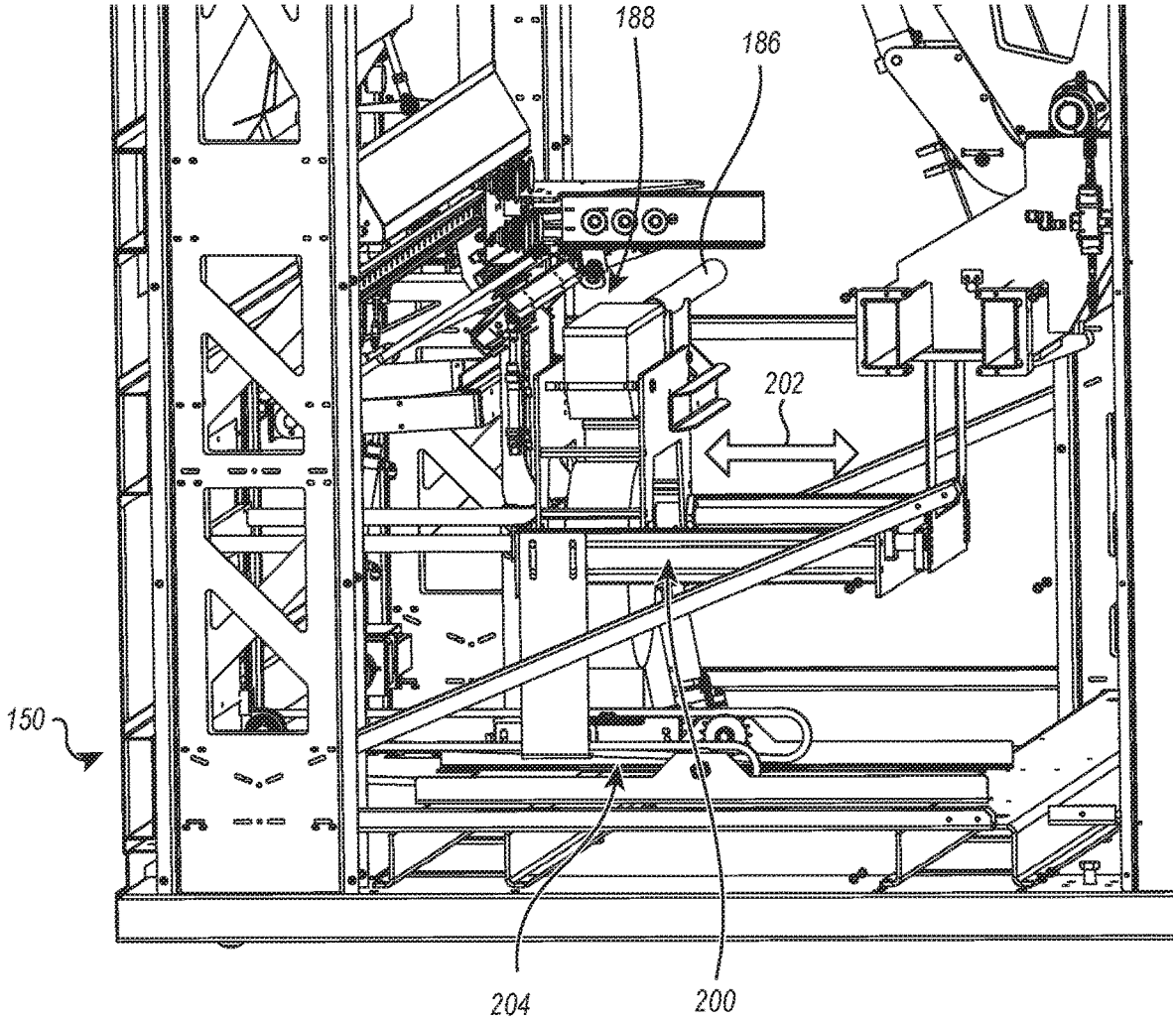
FIG. 24 illustrates an assembly for moving a closure mechanism of the box erecting machine.

FIG. 24 illustrates an example embodiment of the mechanism for adjusting the position of the closure mechanism 188. As can be see, the closure mechanism 188 is mounted on a carriage 200. The closure mechanism 188 is movable relative to the carriage 200 between the front and rear ends of the carriage in the directions indicated by arrow 202, such that the closure mechanism 188 can move closer to or further away from the front of machine 150. Additionally, carriage 200 is also movable closer to or further away from the front of machine 150 in the directions indicated by arrow 202.

In some embodiments, the position of the closure mechanism 188 (and optionally the carriage 202) can be adjusted to allow for additional room between the closure mechanism 188 and the first vacuum head 180 and/or the track 192. For instance, when an un-erected box 122 is moved by the transport mechanism 160 from the rear of the machine 150 to the front of the machine 150, the closure mechanism 188 may be moved towards the rear of the machine 150 to create sufficient space for the un-erected box to pass between the closure mechanism 188 and the first vacuum head 180 and/or the track 192.

In some embodiments, the position of the carriage 200 and the position of the closure mechanism 188 relative to the carriage 200 can be adjusted to align the closure mechanism 188 with the bottom seam of the box. For instance, the carriage 200 can be moved to a predetermined position for a box having a particular width. For narrower boxes, the carriage is moved closer to the front of machine 150. For wider boxes, the carriage is moved further away from the front of machine 150. With the carriage 202 moved to the predetermined position for a given box width, the closure mechanism 188 can be moved to a front-most position on the carriage 202 to align the closure mechanism 188 with the bottom seam of the box.

As can be seen in FIG. 24, the second folding bar 186 is connected to the closure mechanism 188 such that the two components move together. As a result, a single actuator can be used to both move the second folding bar 186 to fold one of the bottom major flaps of the box and to align the closure mechanism 188 with the bottom seam of the box.

Figure 23:
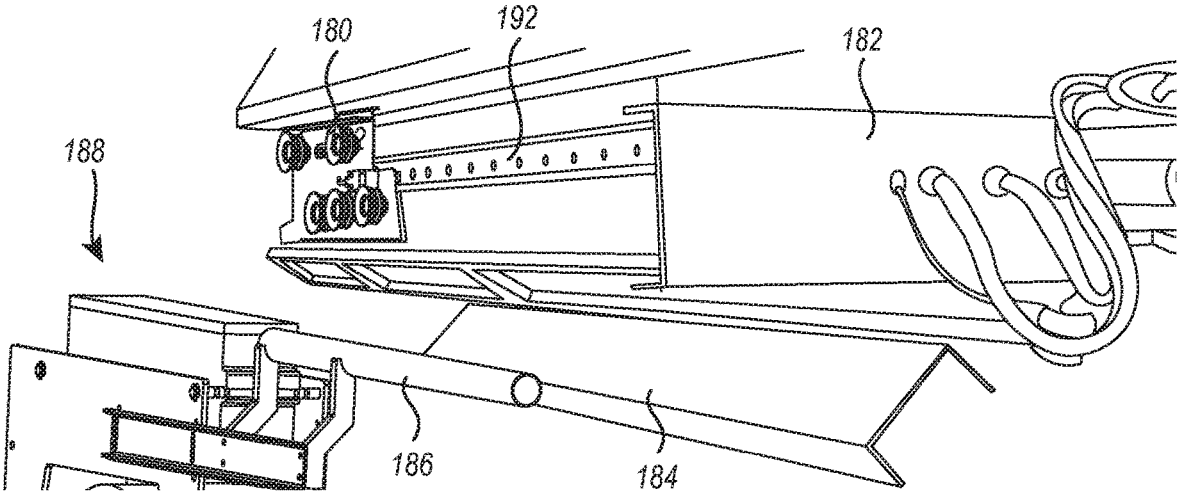

After the first vacuum head 180 has moved the box past the closure mechanism 188, the first vacuum head 180 can move the box to the discharge opening 156 of machine 150. At that point, the first vacuum head 180 can disengage the box (e.g., by deactivating the vacuum cups 190 thereof). The box can then proceed to another area to be filled and closed. The first vacuum head 180 can move back along track 192 towards second vacuum head 182, as shown in FIG. 23.

In some embodiments, the movements of the second vacuum head 182, the datum surface 189, and the carriage 202 (on which the closure mechanism 188 is mounted) are linked together. For instance, the second vacuum head 182, the datum surface 189, and the carriage 202 can be linked together by a plurality of drive chains 204 (one of which is shown in FIG. 24). The plurality of drive chains 204 may be connected to and driven by a single motor 206 (FIG. 11). By linking the movements of the noted components, all of the movements can be driven and controlled by a single motor. Additionally, linking the movements of the noted components can ensure that the amount of movement for each component is accurate and tied to the specific box size being erected. For instance, adjustments made to the position of the second vacuum head 182 or the datum surface 189 can be made to ensure the proper positioning of an un-erected box within the machine as described herein. Because the second vacuum head 182, the datum surface 189, and the carriage 202 are linked together, such adjustments to one of the noted components will automatically adjust the position of the other noted components. As a result, each of the noted components will be properly positioned based on the size of the box being erected.

Attention is now directed to FIGS. 25-31, which emphasize and more clearly illustrate an example process for erecting a box from an un-erected box 122. As will be appreciated from the following discussion, box erecting machine 150 is not necessary to erect a box according to the present disclosure. Rather, the disclosed process for erecting a box can be performed by other machines or manually by a person.

Figure 25:
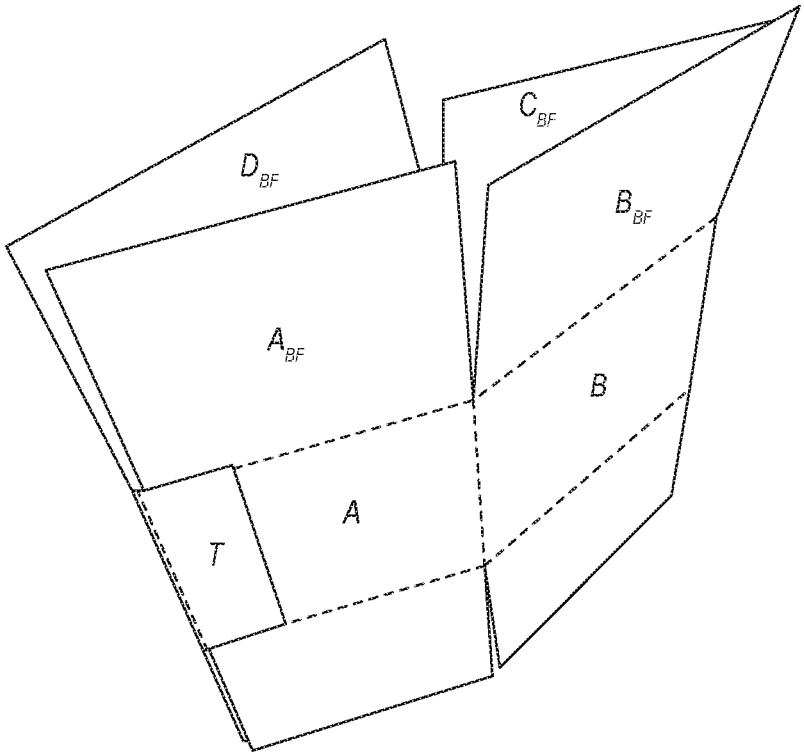
FIGS. 25-31 illustrate an example method of erecting a box.

FIG. 25 illustrates an un-erected box 122 in a generally flap configuration, similar to that shown in FIG. 2B. A manufacturer's joint is formed at the attachment interface between glue tab T and sidewall panel A. The bottom flaps $A_{BF}$, $B_{BF}$, $C_{BF}$, $D_{BF}$ extend from the corresponding sidewall panels A-D. In the illustrated embodiment, bottom flaps $A_{BF}$ and $C_{BF}$ are minor flaps that extend along the width of the erected box and bottom flaps $B_{BF}$ and $D_{BF}$ are major flaps that extend along the length of the erected box.

Figure 26:
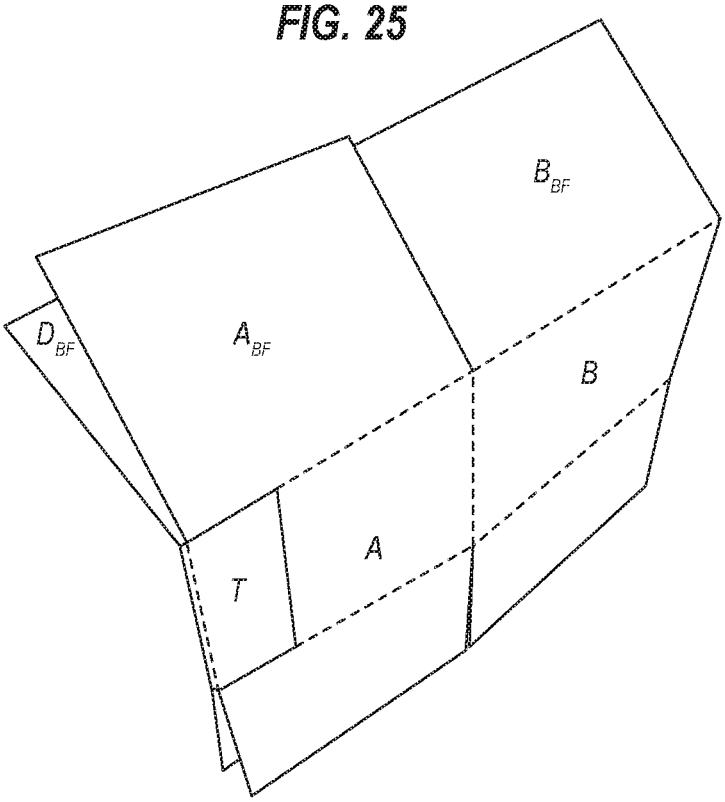

According to the illustrated example erecting process, all of the bottom flaps $A_{BF}$, $B_{BF}$, $C_{BF}$, $D_{BF}$ are folded (relative to there respective sidewall panels A-D) in a first direction as shown in FIG. 26. In some embodiments, the bottom flaps $A_{BF}$, $B_{BF}$, $C_{BF}$, $D_{BF}$ are folded to an angle of 15°, 30°, 45°, or 90°, or any angle therebetween relative to the sidewall panels A-D.

Folding the bottom flaps $A_{BF}$, $B_{BF}$, $C_{BF}$, $D_{BF}$ relative to the sidewall panels A-D straightens and provides structural rigidity to the sidewall panels A-D. As noted above, the sheet material 104 used to form un-erected box 122 may come from a bale 102. To form a bale 102 with the sheet material 104, folds (referred to as fanfold creases) are formed in the sheet material 104. When an un-erected box 122 is formed with the sheet material 104, some of the fanfold creases may extend through a sidewall and the associated top and bottom flaps thereof. The fanfold creases can cause the sidewalls and flaps to bend or fold in undesired locations. However, by folding the flaps relative to the sidewalls, the fanfold creases are straightened out.

Figure 27:
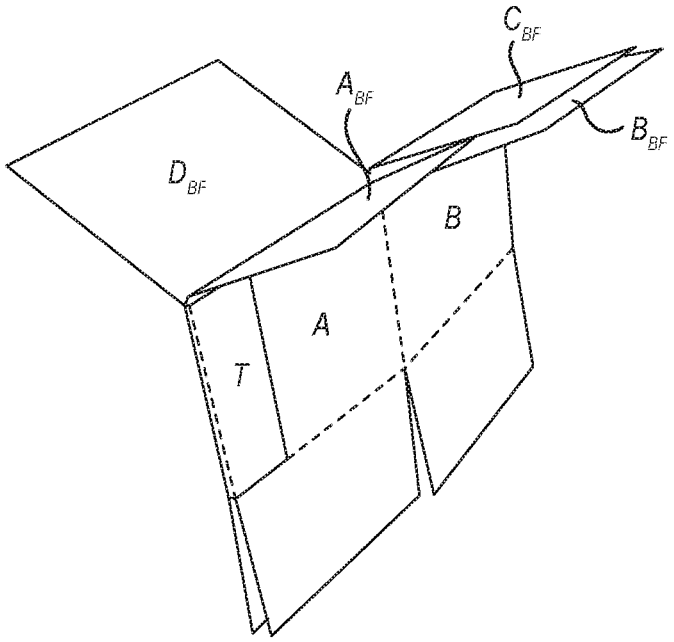

After folding all of the bottom flaps $A_{BF}$, $B_{BF}$, $C_{BF}$, $D_{BF}$ in the first direction, three of the bottom flaps $A_{BF}$, $B_{BF}$, $C_{BF}$ can be folded (relative to the sidewall panels A-C) in a second direction opposite to the first direction, as shown in FIG. 27. In some embodiments, the bottom flaps $A_{BF}$, $B_{BF}$, $C_{BF}$ are folded to an angle of 15°, 30°, 45°, or 90°, or any angle therebetween relative to the sidewall panels A-C. Notably, bottom flap $D_{BF}$ is held in the angled position created from the first fold. With the bottom flaps $A_{BF}$, $B_{BF}$, $C_{BF}$, $D_{BF}$ so folded, the sidewall panels A-D are maintained in straight and rigid configurations.

Figure 28:
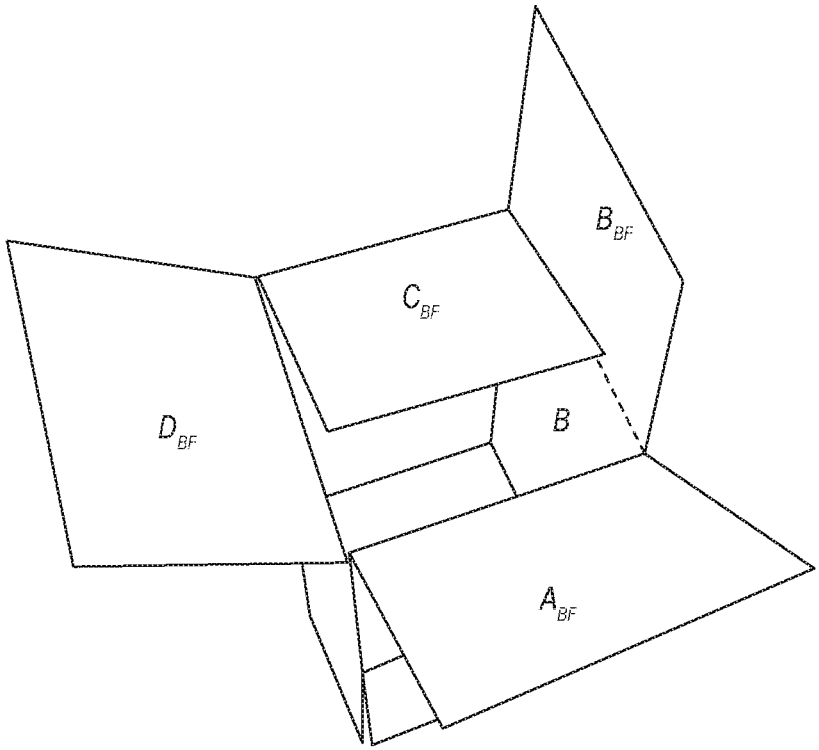

With the bottom flaps $A_{BF}$, $B_{BF}$, $C_{BF}$, $D_{BF}$ folded as shown in FIG. 27, the un-erected box 122 can be opened or unfolded so that the sidewall panels A-D form a generally rectangular tube as shown in FIG. 28. When un-erected box 122 is so opened or unfolded, one or more of the bottom flaps can be maintained in or folded to an angled orientation relative to their associated sidewall panel(s) to maintain the sidewall panels in straight configurations. In some embodiments, it is preferable to fold or maintain two, three, or four of the bottom flaps in an angled orientation.

For instance, in the embodiment shown in FIG. 28, bottom flaps $A_{BF}$ and $D_{BF}$ are maintained in the angled orientation formed during the first and second folds. In contrast, bottom flap $C_{BF}$ is folded towards the interior of the un-erected box 122. In the illustrated embodiment, bottom flap $C_{BF}$ is folded to form about a 90° angle with sidewall panel C. With bottom flaps $A_{BF}$, $B_{BF}$, $C_{BF}$ so folded, each of sidewall panels A-C is held in a straight and rigid configuration.

In some embodiment, such as that shown in FIG. 28, bottom flap $B_{BF}$ can be unfolded relative to sidewall panel B (such that bottom flap $B_{BF}$ and sidewall panel B are generally coplanar). In some cases, this may allow sidewall panel B to bend or fold along a fanfold crease that extends therethrough. As will be discussed below, as long as the other three sidewall panels A-C are held straight (e.g., by the angled orientation of their associated bottom flaps $A_{BF}$, $C_{BF}$, $D_{BF}$, any folds or bends in sidewall panel B will not pose a significant problem. In other embodiments, however, bottom flap $B_{BF}$ can be folded away from the interior of the un-erected box 122 (similar to bottom flap $D_{BF}$, except in the opposite direction) to maintain sidewall panel B is a straight configuration.

Figure 29:
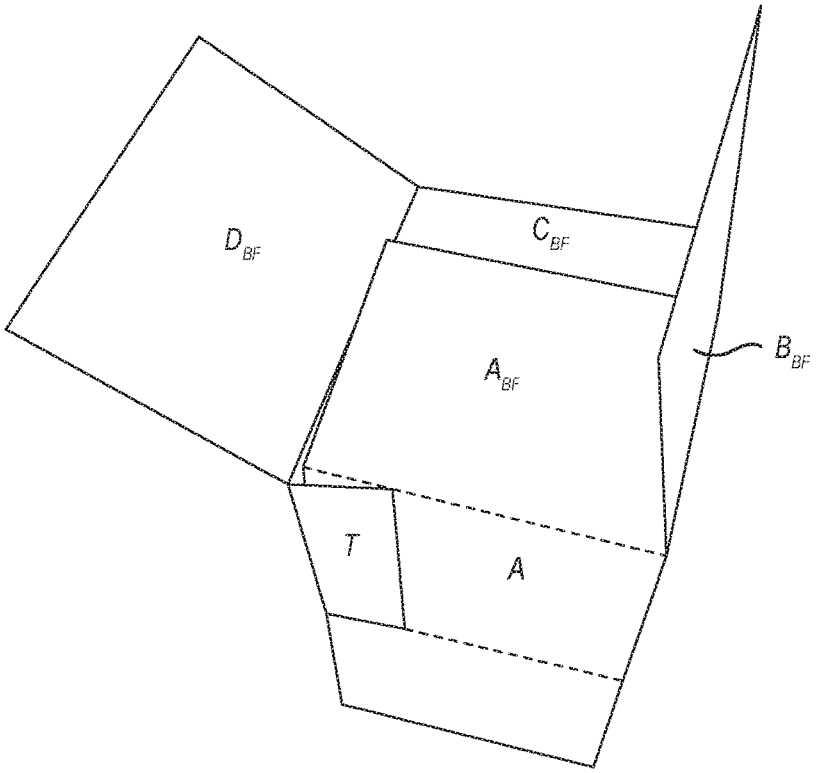
Figure 30:
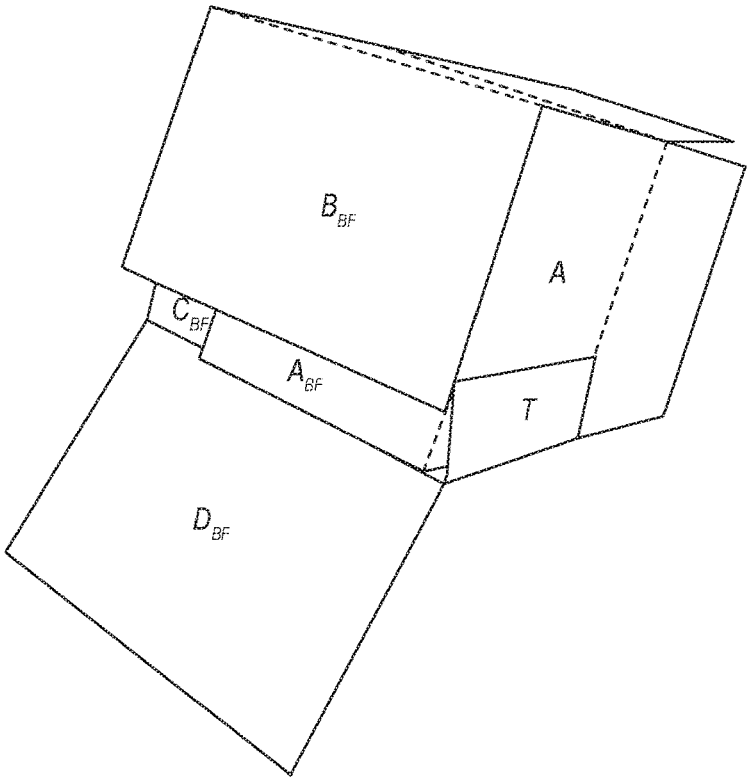

In any event, bottom flap $A_{BF}$ can then be folded in towards the interior of the un-erected box 122 as shown in FIG. 29. In the illustrated embodiment, bottom flap $A_{BF}$ is folded to form about a 90° angle with sidewall panel A. With the bottom minor flaps $A_{BF}$, $C_{BF}$ folded in, the bottom major flaps $B_{BF}$, $D_{BF}$ can be folded in to close the bottom of the box. As shown in FIG. 30, for instance, bottom major flap $B_{BF}$ is folded towards bottom minor flaps $A_{BF}$, $C_{BF}$.

Figure 31:
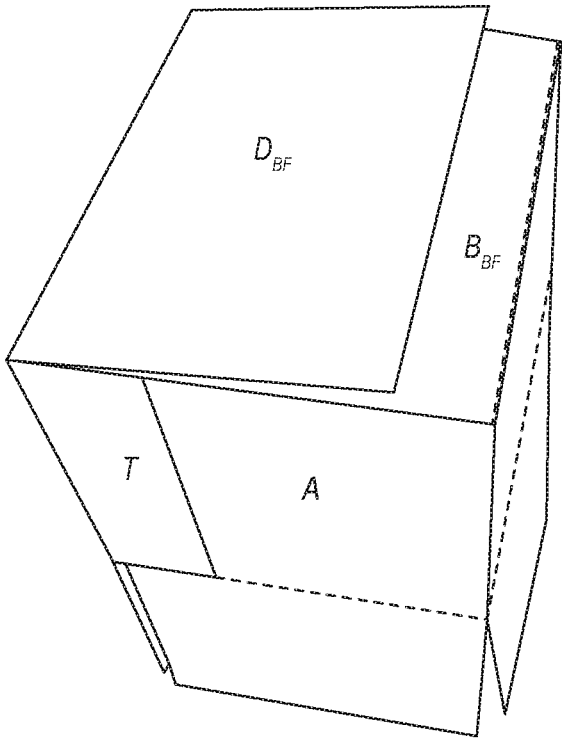

As noted above, sidewall panel B and bottom flap $B_{BF}$ may bend or fold as a result of a fanfold crease extending therethrough. Due to the straightness and rigidity of the sidewall panels A, C, D and the folded bottom flaps $A_{BF}$, $C_{BF}$, $D_{BF}$, any such bend or fold will cause sidewall panel B and bottom flap $B_{BF}$ to bow outwards. Such bowing will not overly hinder the ability to fold bottom flap $B_{BF}$. For instance, as shown in FIG. 30, bottom flap $B_{BF}$ can be readily folded to close the bottom of the box. As shown, bottom major flap $B_{BF}$ is folded towards bottom flap $A_{BF}$, $C_{BF}$. Prior to are after bottom flap $B_{BF}$ is folded closed, bottom flap $D_{BF}$ can be folded closed as shown in FIG. 31.

In light of the above, it will be readily appreciated that a box erecting process according to the present disclosure includes folding and maintaining at least one flap at an angle relative to its associated sidewall panel during the erecting process. In some embodiments, two, three, or four flaps may be folded and maintained at an angle relative to their associated sidewall panels during the erecting process. In some embodiments, only or at least the flaps associated with sidewall panels having fanfold creases extending therethrough are folded and maintained at an angle relative to the associated sidewall panel(s) in order to flatten and stiffen the sidewall panel(s) during the box erecting process as described herein.

While FIGS. 25-31 illustrate and describe folding and maintaining the flaps in certain directions, it will be appreciated that the direction of the folds is merely exemplary. For instance, rather than folding all of the bottom flaps in a first direction and then folding some of the flaps in a second direction as shown in FIGS. 26 and 27, some of the flaps could be folded in a first direction and some other flaps could be folded in a second direction. By way of example, at least one of flaps $A_{BF}$, $B_{BF}$ could be folded outward in one direction and at least one of flaps $C_{BF}$, $D_{BF}$ could be folded outward in a second opposite direction. Thereafter, the un-erected box could be opened or unfolded so the sidewall panels form a rectangular tube. The minor flaps could then be folded in followed by folding in of the major flaps.

In still other embodiments, bottom flaps $A_{BF}$, $D_{BF}$ could be folded in one direction and bottom flaps $B_{BF}$, $C_{BF}$ could be folded in a second opposite direction. Thereafter, the un-erected box could be opened or unfolded so the sidewall panels form a rectangular tube. With this process, when the un-erected box is opened or unfolded into a rectangular tube, the minor bottom flaps $A_{BF}$, $C_{BF}$ would already be at least partially folded inward towards the closed position. Thereafter, the folding closed of the bottom minor flaps $A_{BF}$, $C_{BF}$ could be completed. Then the bottom major flaps $D_{BF}$, $B_{BF}$ could be folded closed.

Thus, it will be clear that erecting a box from an un-erected box can be done through a variety of processes, with or without machine assistance. In any case, however, one or more of the bottom flaps is folded and held at an angle or in an angled orientation relative to the corresponding sidewall panel(s) during the box erecting process. In some embodiments, a single bottom panel can be in an angled orientation during the erecting process, while in other embodiments, two, three, or four bottom panels can be held in angled orientations during the erecting process. It will also be appreciated that the direction of the angled orientation and/or the degree of the angle may vary from one embodiment to another. For instance, a single bottom flap may be folded in a first direction and one or more of the other bottom flaps may be folded in a second direction. In other embodiments, two bottom flaps may be folded in a first direction and two bottom flaps may be folded in a second direction. In some embodiments, one or more bottom flaps may not be folded or held in an angled orientation while one or more other bottoms flaps are folded and held in angled orientations.

In one embodiment, a method for erecting an un-erected box into a box, comprising providing an un-erected box having first, second, third, and fourth sidewall panels and first, second, third, and fourth bottom flaps extending from the corresponding first, second, third, and fourth sidewall panels. The un-erected box may be folded between the second and third sidewall panels and the first and fourth sidewall panels may be secured to one another. The method also includes folding one or more of the bottom flaps relative to the corresponding sidewall panel(s) such that the one or more bottom flaps and the corresponding sidewall panel(s) form one or more angles of greater than 0°. The method further includes arranging the un-erected box so that the first, second, third, and fourth sidewall panels form a generally rectangular tube while the one or more bottom flaps are oriented at an angle of greater than 0° relative to the corresponding sidewall panel(s). The method also includes folding the first and third bottom flaps to a closed position and folding the second and fourth bottom flaps to a closed position.

In some embodiments, arranging the un-erected box includes folding the third bottom flap to a closed position.

In some embodiments, the method also includes maintaining the fourth bottom flap in an angled orientation in a first direction while the first, second, and third bottom flaps are folded in a second direction.

In some embodiments, after folding the one or more bottom flaps relative to the corresponding sidewall panel(s), the one or more bottom flaps are maintained in a folded orientation relative to their associated sidewall panel(s) during the remainder of the method.

In some embodiments, folding the one or more bottom flaps relative to the corresponding sidewall panel(s) comprises folding the first and second bottom flaps and the third and fourth bottom flaps in opposite directions.

In some embodiments, folding one or more of the bottom flaps relative to the corresponding sidewall panel(s) comprises folding the one or more bottom flaps such that the one or more bottom flaps and the corresponding sidewall panel(s) form one or more angles of greater than 0° and less than 90°.

In some embodiments, at least one of the sidewall panels comprises a crease or fold extending therethrough, and folding the one or more bottom flaps relative to the corresponding sidewall panel(s) flattens or unfolds the crease or fold extending through the at least one sidewall panel.

In another embodiment, a box erecting assembly is configured to erect an un-erected box into an erected box. The un-erected box can include first, second, third, and fourth bottom flaps extending from corresponding first, second, third, and fourth sidewall panels. The box erecting assembly includes an opening or unfolding mechanism configured to open or unfold the un-erected box from a first configuration into a second configuration where the first, second, third, and fourth sidewall panels form a generally rectangular tube. The assembly also includes a folding mechanism configured to fold bottom flaps of the un-erected box. The folding mechanism can be configured to fold one or more of the bottom flaps into an angled orientation relative to the associated sidewall panel(s). The folding mechanism can be configured to maintain the one or more bottom flaps in an angled orientation while the opening or unfolding mechanism opens or unfolds the un-erected box into the second configuration. The assembly also includes a closure mechanism that is configured to secure the bottom flaps in the closed configuration.

In some embodiments, the folding mechanism comprises one or more pivoting folding bars configured to pivot to fold the one or more bottom flaps of the un-erected box into the angled orientation.

In some embodiments, at least one of the one or more pivoting folding bars comprises a pivoting upper end that is configured to pivot to fold one or more of the bottom flaps to a fully closed position.

In some embodiments, the opening or unfolding mechanism comprises one or more angled gripping devices configured to selectively hold or maintain the one or more bottom flaps in the angled orientation.

In some embodiments, the one or more angled gripping devices are configured to maintain the fourth bottom flap in the angled orientation while the opening or unfolding mechanism opens or unfolds the un-erected box into the second configuration.

In some embodiments, the one or more angled gripping devices are configured to maintain the fourth bottom flap in the angled orientation while the folding mechanism folds the first and third bottom flaps to the closed configuration.

In some embodiments, the folding mechanism is configured to fold the first and second bottom flaps in a first direction and the third and fourth bottom flaps in a second direction opposite to the first direction prior to the opening or unfolding device opening or unfolding the un-erected box into the second configuration.

In some embodiments, the assembly also includes a transport mechanism that can pivot between a rear position and a forward position to transport an un-erected box from an entry portion of the box erecting assembly to a forward portion of the box erecting assembly.

In some embodiments, the transport mechanism comprises one or more pivot arms that can pivot the transport mechanism between the rear position and the forward position.

In some embodiments, the transport mechanism also includes a clamp connected to the one or more pivot arms, the clamp being configured to selectively clamp onto an un-erected box, the clamp being movable to reposition and/or reorient the un-erected box as the transport mechanism pivots between the rear and forward positions In some embodiments, the pivoting movement of the one or more pivot arms and the movability of the clamp are configured to position an un-erected box in a desired position and orientation relative to the opening or unfolding mechanism and the folding mechanism.

In some embodiments, at least a portion of the opening or unfolding mechanism is configured to move horizontally to engage and position the un-erected box is a predetermined position.

In some embodiments, the closure mechanism comprises a tape head, a glue applicator, or a stapler.

In some embodiments, the closure mechanism and at least a portion of the folding mechanism are connected together such that the closure mechanism and the at least a portion of the folding mechanism move together.

In some embodiments, the assembly also comprises a datum surface configured to support and position an un-erected box in a desired position.

In some embodiments, the position of the datum surface is selectively adjustable.

In some embodiments, the position of the datum surface is linked to the position of the closure mechanism and the at least a portion of the folding mechanism.

In some embodiments, the positions of the closure mechanism, the at least a portion of the folding mechanism, and the datum surface are selectively adjustable via a common actuator.

In another embodiment, a box erecting machine includes a transport mechanism that can pivot between a rear position and a forward position to transport an un-erected box from an entry portion of the box erecting machine to a forward portion of the box erecting machine. The transport mechanism can include one or more pivot arms that can pivot the transport mechanism between the rear position and the forward position, and a clamp configured to selectively clamp onto an un-erected box. The clamp can be movable to reposition the un-erected box along a width of the box erecting machine as the transport mechanism pivots between the rear and forward positions. The clamp can be rotatable about an axis, rotation of the clamp about the axis being configured to reorient the un-erected box from a generally horizontal orientation to a generally vertical orientation.

In another embodiment, a method for erecting a box includes providing an un-erected box having a plurality of sidewall panels and a plurality of flaps extending from the plurality of sidewall panels, at least one sidewall panel of the plurality of sidewall panels having a crease or fold extending therethrough. The method also includes folding at least one flap associated with the at least sidewall panel relative to the at least one sidewall panel, wherein folding the at least one flap relative to the at least one sidewall panel flattens or unfolds the crease or fold extending through the at least one sidewall panel. The method also includes arranging the un-erected box so that the plurality of sidewall panels form a generally rectangular tube while the at least one flap is folded relative to the at least one sidewall panel.

In some embodiments, folding the at least one flap relative to the at least one sidewall panel comprises folding the at least one flap such that the at least one flap and the at least one sidewall panel form an angle of greater than 0° and less than 90°.

In some embodiments, the method includes folding more than one of the flaps relative to the associated sidewall panels.

In some embodiments, the method also includes maintaining the more than one flap in folded positions relative to the associated sidewall panels while arranging the un-erected box so that the plurality of sidewall panels form a generally rectangular tube.

The present invention may be embodied in other specific forms without departing from its spirit or essential characteristics. The described embodiments are to be considered in all the tough to respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A method for erecting an un-erected box into a box, comprising:

providing an un-erected box having first, second, third, and fourth sidewall panels and first, second, third, and fourth bottom flaps extending from the corresponding first, second, third, and fourth sidewall panels, the un-erected box being folded between the second and third sidewall panels and the first and fourth sidewall panels being secured to one another, the first and second sidewalls being generally coplanar in a first plane, and the third and fourth sidewalls being generally coplanar in a second plane, the first and second planes being generally parallel to one another;

while the first and second sidewalls are in the first plane and the third and fourth sidewalls are in the second plane, folding two or more of the bottom flaps relative to the corresponding sidewall panels, the two or more bottom flaps being folded by one or more angles of greater than 0° and equal to or less than 90° relative to the original positions of the two or more bottom flaps in the first or second plane;

after folding two or more of the bottom flaps, arranging the un-erected box so that the first, second, third, and fourth sidewall panels form a generally rectangular tube while the two or more bottom flaps are oriented at the folded angle of greater than 0° and equal to or less than 90° relative to the corresponding sidewall panel;

folding the first and third bottom flaps to a closed position; and folding the second and fourth bottom flaps to a closed position.

2. The method of claim 1, wherein arranging the un-erected box includes folding the third bottom flap to a closed position.

3. The method of claim 1, further comprising maintaining the fourth bottom flap in an angled orientation in a first direction while the first, second, and third bottom flaps are folded in a second direction.

4. The method of claim 1, wherein, after folding the two or more bottom flaps relative to the corresponding sidewall panels, the two or more bottom flaps are maintained in a folded orientation relative to their associated sidewall panels during the remainder of the method.

5. The method of claim 1, wherein folding the two or more bottom flaps relative to the corresponding sidewall panels comprises folding the first and second bottom flaps and the third and fourth bottom flaps in opposite directions prior to arranging the un-erected box so that the first, second, third, and fourth sidewall panels form a generally rectangular tube.

6. The method of claim 1, wherein folding the two or more bottom flaps relative to the corresponding sidewall panels comprises folding the two or more bottom flaps by one or more angles of greater than 0° and less than 90°.

7. The method of claim 1, wherein the first, second, third, and fourth sidewall panels are joined together at creases or folds that form the corners of the box, and wherein at least one of the sidewall panels comprises a crease or fold extending therethrough, the crease or fold that extends through the at least one sidewall panel being oriented generally parallel to and disposed in between the creases or folds that form the corners of the box, and wherein folding the one or more bottom flaps relative to the corresponding sidewall panels flattens or unfolds the crease or fold extending through the at least one sidewall panel.

8. A box erecting assembly configured to erect an un-erected box into an erected box, the un-erected box comprising first, second, third, and fourth bottom flaps extending from corresponding first, second, third, and fourth sidewall panels, the first and second sidewalls being generally coplanar in a first plane, and the third and fourth sidewalls being generally coplanar in a second plane, the first and second planes being generally parallel to one another, the box erecting assembly comprising:

a folding mechanism configured to fold two or more of the bottom flaps of the un-erected box into an angled orientation relative to the associated sidewall panels while the first and second sidewalls are in the first plane and the third and fourth sidewalls are in the second plane, the angled orientation being one or more angles of greater than 0° and equal to or less than 90° relative to the original positions of the two or more bottom flaps in the first or second plane;

an opening or unfolding mechanism configured to open or unfold the un-erected box into a second configuration where the first, second, third, and fourth sidewall panels form a generally rectangular tube, the opening or unfolding mechanism being configured to open or unfold the un-erected box into the second configuration after the folding mechanism has folded the two or more bottom flaps relative to the associated sidewalls, the opening or unfolding mechanism being configured to selectively attach to an outer surface of at least one of the first, second, third, and fourth sidewall panels and to exert a pulling force on the outer surface of the at least one of the first, second, third, and fourth sidewall panels to move the un-erected to the second configuration, the pulling force being exerted in a direction away from an interior of the un-erected box; and a closure mechanism that is configured to secure the bottom flaps in a closed configuration.

9. The box erecting assembly of claim 8, wherein the folding mechanism comprises one or more pivoting folding bars configured to pivot to fold the two or more bottom flaps of the un-erected box into the angled orientation.

10. The box erecting assembly of claim 9, wherein at least one of the one or more pivoting folding bars comprises a pivoting upper end that is configured to pivot to fold one or more of the bottom flaps to a fully closed position.

11. The box erecting assembly of claim 8, wherein the opening or unfolding mechanism comprises one or more angled gripping devices configured to selectively hold or maintain one or more bottom flaps in the angled orientation.

12. The box erecting assembly of claim 11, wherein the one or more angled gripping devices are configured to maintain the fourth bottom flap in the angled orientation while the opening or unfolding mechanism opens or unfolds the un-erected box into the second configuration.

13. The box erecting assembly of claim 11, wherein the one or more angled gripping devices are configured to maintain the fourth bottom flap in the angled orientation while the folding mechanism folds the first and third bottom flaps to the closed configuration.

14. The box erecting assembly of claim 8, wherein the folding mechanism is configured to fold the first and second bottom flaps in a first direction and the third and fourth bottom flaps in a second direction opposite to the first direction prior to the opening or unfolding device opening or unfolding the un-erected box into the second configuration.

15. The box erecting assembly of claim 8, further comprising a transport mechanism that can pivot between a rear position and a forward position to transport an un-erected box from an entry portion of the box erecting assembly to a forward portion of the box erecting assembly.

16. The box erecting assembly of claim 15, wherein the transport mechanism comprises:

one or more pivot arms that can pivot the transport mechanism between the rear position and the forward position; and a clamp connected to the one or more pivot arms, the clamp being configured to selectively clamp onto an un-erected box, the clamp being movable to reposition and/or reorient the un-erected box as the transport mechanism pivots between the rear and forward positions, wherein the pivoting movement of the one or more pivot arms and the movability of the clamp are configured to position an un-erected box in a desired position and orientation relative to the opening or unfolding mechanism and the folding mechanism.

17. The box erecting assembly of claim 8, wherein at least a portion of the opening or unfolding mechanism is configured to move horizontally to engage and position the un-erected box is a predetermined position.

18. The box erecting assembly of claim 8, wherein the closure mechanism comprises a tape head, a glue applicator, or a stapler.

19. The box erecting assembly of claim 8, wherein the closure mechanism and at least a portion of the folding mechanism are connected together such that the closure mechanism and the at least a portion of the folding mechanism move together.

20. The box erecting assembly of claim 19, further comprising a datum surface configured to support and position an un-erected box in a desired position.

21. The box erecting assembly of claim 20, wherein the position of the datum surface is selectively adjustable.

22. The box erecting assembly of claim 21, wherein the position of the datum surface is linked to the position of the closure mechanism and the at least a portion of the folding mechanism.

23. The box erecting assembly of claim 22, wherein the positions of the closure mechanism, the at least a portion of the folding mechanism, and the datum surface are selectively adjustable via a common actuator.

24. A box erecting machine comprising:

a transport mechanism that can pivot between a rear position and a forward position to transport an un-erected box from an entry portion of the box erecting machine to a forward portion of the box erecting machine, the transport mechanism comprising:

one or more pivot arms that can pivot the transport mechanism about a pivot arm axis between the rear position and the forward position; and a clamp configured to selectively clamp onto an un-erected box, the clamp being movable to reposition the un-erected box along a width of the box erecting machine and in a direction generally parallel to the pivot arm axis as the transport mechanism pivots between the rear and forward positions, the clamp being rotatable about a clamp axis, the clamp axis being non-parallel with the pivot arm axis, rotation of the clamp about the clamp axis being configured to reorient the un-erected box from a generally horizontal orientation to a generally vertical orientation.

25. A method for erecting a box, comprising:

providing an un-erected box having a plurality of sidewall panels, a plurality of folds or creases dispose between and partially defining the plurality of sidewall panels, and a plurality of flaps extending from the plurality of sidewall panels, at least one sidewall panel of the plurality of sidewall panels having a crease or fold extending therethrough, the crease or fold that extends through the at least one sidewall panel being oriented generally parallel to and disposed in between the creases or folds that define the at least one sidewall panel;

folding two or more flaps to an angled orientation relative to the corresponding sidewall panels and so that the two or more flaps form one or more angles of greater than 0° and equal to or less than 90° relative to original positions of the two or more flaps in an unfolded configuration, the corresponding sidewall panels including the at least sidewall panel having the crease or fold extending therethrough, wherein folding the flap the at least one sidewall panel to the angled orientation flattens or unfolds the crease or fold extending through the at least one sidewall panel; and while the two or more flaps are folded to the angled orientation, arranging the un-erected box so that the plurality of sidewall panels form a generally rectangular tube.

26. The method of claim 25, wherein folding the two or more flaps relative to the corresponding sidewall panels comprises folding the two or more flaps to an angle of greater than 0° and less than 90° relative to the unfolded positions of the two or more flaps.

27. The method of claim 25, wherein folding two or more flaps comprises folding three or more flaps relative to the associated sidewall panels.

28. The method of claim 27, further comprising maintaining the two or more flaps in the angled orientation while arranging the un-erected box so that the plurality of sidewall panels form a generally rectangular tube.

* * * * *